US006342911B1

(12) United States Patent
Moriya

(10) Patent No.: US 6,342,911 B1
(45) Date of Patent: Jan. 29, 2002

(54) THERMAL HEAD

(75) Inventor: Bunji Moriya, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/538,283

(22) Filed: Mar. 30, 2000

(30) Foreign Application Priority Data

Apr. 1, 1999 (JP) ..... 11-094747

(51) Int. Cl.[7] ..... B41J 2/355; B41J 2/35
(52) U.S. Cl. ..... 347/210
(58) Field of Search ..... 347/210, 195, 347/10; 400/120.15

(56) References Cited

FOREIGN PATENT DOCUMENTS

JP 11-138883 5/1999

JP 11-208008 8/1999

*Primary Examiner*—Huan Tran
(74) *Attorney, Agent, or Firm*—Morgan, Lewis & Bockius LLP

(57) ABSTRACT

The object of the invention is to enable the input of the data of a high energy part and the data of a low energy part to one memory in a thermal head having heating means for heating by different energy. To achieve the object, in a thermal head provided with a shift register to which first energy print data the printing by first energy of which is controlled by heating control means is written and to which second energy print data the printing by second energy of which is controlled by the heating control means is written, the shift register is provided with first shift register elements to which first energy print data is written and second shift register elements to which second energy print data is written, and the first shift register elements and the second shift register elements are connected in series.

15 Claims, 15 Drawing Sheets

THERMAL HEAD

BACKGROUND OF THE INVENTION

The present invention relates to a thermal head that is able to output different heating temperature in the same scanning suitable for a thermal element that develops different colors according to heating temperature for example, particularly relates to a thermal head which is able to reduce the influences of accumulated heat in the thermal head. Furthermore, the present invention relates to a thermal head to which binary data of whether high energy data or low energy data can be serially input.

In case printing is performed on thermosensitive paper by a thermal head, heretofore, printing is performed in fixed color such as black when printing energy (temperature) becomes higher than $T_0$ as shown in FIG. 4A and as printing density becomes light and in the case of energy lower than the energy, the thermal head is not heated in a part in which printing is not desired. That is, only control over operation of whether printing is performed or not according to whether data exists on a line or not is executed.

A thermal head to which a history control circuit for limiting the rise of temperature by heat accumulation in a thermal head board is added to control operation also exists, however, the objective is to control so that a thermal head is under single temperature in printing, that is, single energy.

Recently, multi-color thermosensitive paper that a character and others are printed in black for example when a high temperature thermal head is used and they are printed in red for example when a low temperature thermal head is used is manufactured. For example, it is provided as a product name MB-23 manufactured by Oji Paper Co., Ltd (Japan).

That is, this type of thermosensitive paper develops red for example when the printing energy (temperature) of a thermal head is $T_2$ as shown in FIG. 4B and develops black when the printing energy is $T_1$($T_2<T_1$). When the printing energy becomes further higher than $T_1$, whitening effect occurs. As apparent from FIG. 4B, this type of thermosensitive paper has two developing energy peaks $T_2$ and $T_1$ for red and black. This type of thermosensitive paper enabling not only the combination of red and black but the combination of other colors according to the degree of printing energy also exists.

In case red and black printing is performed on a scanning line $L_0$ as shown in FIG. 5A for example when plural-color printing is performed using such multi-color thermosensitive paper, it is conventionally required to first transfer data to be printed in red by current of quantity corresponding to low temperature and to then transfer data on the same scanning line $L_0$ again by current of quantity corresponding to high temperature.

Also, as shown in FIG. 5B, in case red and black two-color printing is performed, data to be printed in red on scanning lines L1, L2, - - - is transferred by current of quantity corresponding to low temperature and then, data on the same scanning lines L1, L2, - - - is transferred by current of quantity corresponding to high temperature.

As described above, to correspond to two types of energy, data is transferred per one line twice and each energy is set. As data is required to be transferred per one line twice, there is a problem that printing speed is slow.

SUMMARY OF THE INVENTION

A first object of the present invention is to provide a thermal head which is able to output different heating temperatures corresponding a plural colors in a single scanning to a thermal sensitive medium which develops different colors depending on the heating temperature.

A second object of the present invention is to provide a thermal head in that data to be printed by high energy in the vicinity of data to be printed by low energy was prevented from having an effect upon data to be printed by low energy. A third object of the invention is to provide a thermal head in that the data of a high energy part and the data of a low energy part respectively input to a shift register are not input in parallel but can be serially input to solve the problems.

To achieve the object, the thermal head comprises a first strobe signal input means performing the heating control of a heating means corresponding to first energy, a second strobe signal input means performing the heating control of the heating means corresponding to second energy, a first heating time control means for controlling the heating of the heating means based on the first strobe signal depending on the presence/absence of a print data within a print control range under control of the first energy, and a second heating time control means for controlling the heating of the heating means based on the second strobe signal depending on the presence/absence of a print data within a print control range under control of the second energy.

Further, connecting means may be provided to notify the print data to be printed by first energy to the second heating time control means.

Furthermore, a shift register 100 according to the invention is characterized in that as shown in FIG. 1, first shift register elements 101-1 to 101-n for storing the data of a high energy part are connected in series, second shift register elements 102-1 to 102-n for storing the data of a low energy part are connected in series and the first shift register element 101-n and the second shift register element 102-1 are connected in series.

First, a n-bit data string of a low energy part is input from an input terminal Ti. Hereby, the n-bit data string of the low energy part is held in the first shift register element 101-1, - - - or 101-n. Next, when a n-bit data string of a high energy part is similarly input from the input terminal Ti, the n-bit data string of the low energy part first input is held in the second shift register element 102-1, - - - or 102-n and the data string of the high energy part is held in the first shift register element 101-1, - - - or 101-n.

These data are input to a control circuit shown in FIG. 11 for example as Q1 and q1 and printing processing is executed. As described above, input data can be serially input from the input terminal Ti without being input in parallel.

DETAILED DESCRIPTION OF THE PREFERRED EMBODIMENTS

First Embodiment first embodiment will be described below with reference to the drawings. FIG. 6 shows a control circuit per one dot of the thermal head and FIG. 7 is an explanatory drawing for explaining a control signal applied to the control circuit.

Figure 6A:
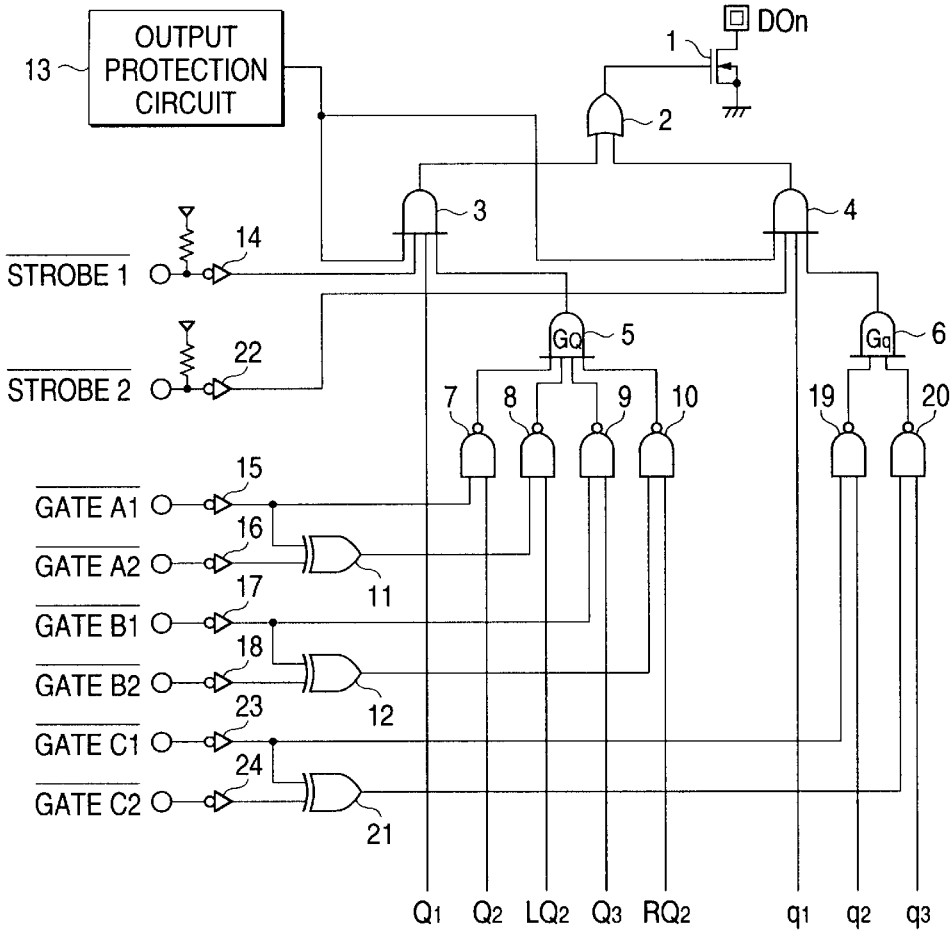
FIGS. 6A to 6C show a control circuit according to a first embodiment.

As shown in FIG. 6A, a reference number 1 denotes a field-effect transistor (FET), a heater for one dot of the thermal head not shown is connected to its terminal DOn and FET controls the on and off of the terminal. A reference number 2 denotes an OR circuit, 3 to 5 denote a multi-input AND circuit, 6 denotes an AND circuit, 7 to 10 denote a NAND circuit, 11 and 12 denote an exclusive OR circuit, 13 denotes an output protection network, 14 to 18 denote an inverter, 19 and 20 denote a NAND circuit, 21 denotes an exclusive OR circuit and 22 to 24 denote an inverter.

The output protection network 13 outputs '1' to the multi-input AND circuits 3 and 4 when IC composing the thermal head is normally operated.

Figure 6B:
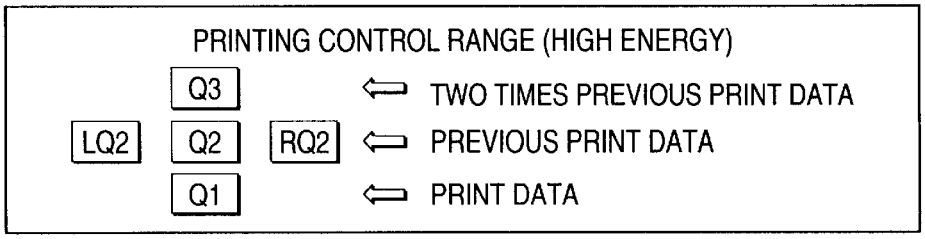
Figure 6C:
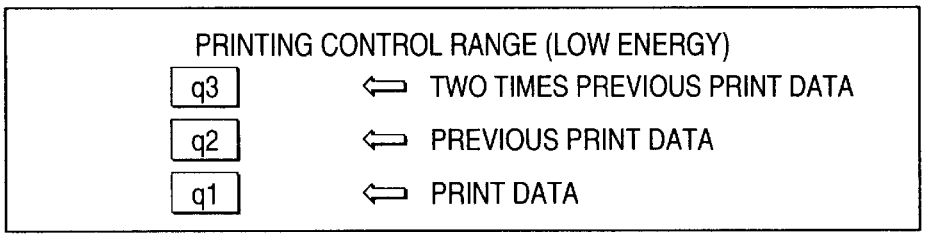

Signals shown in FIG. 6A Q1, Q2, Q3, LQ2 and RQ2 showing whether print dots Q1, Q2, Q3, LQ2 and RQ2 of a high energy part shown in FIG. 6B exist or not are input, and signals shown in FIG. 6A q1, q2 and q3 showing whether print dots q1, q2 and q3 of a low energy part shown in FIG. 6C exist or not are input.

As described later, a strobe pulse STROBE1 is issued to print in black on paper by heating the thermal head as a high energy part for a long time, a strobe pulse STROBE2 is issued to print in red for example on paper by heating the thermal head as a low energy part for a short time and STROBE1>STROBE2.

In case there is no print data at Q2, Q3 and LQ2 and RQ2 when the corresponding print dot Q1 shown in FIG. 6B is printed, these dots are '0', as the NAND circuits 7 to 10 all output '1', the multi-input AND circuit 5 and the multi-input AND circuit 3 both output '1', hereby, the OR circuit 2 turns on FET1 by defined time T1 according to a strobe pulse STROBE1 and the heater of the thermal head is heated.

However, in case there is print data at at least one of Q2, Q3, LQ2 and RQ2, '0' is output from the multi-input AND circuit 5 by time controlled according to a gate signal A1, B1, A2 and/or B2 according to the print data as described later in consideration of the effect of heat accumulation so as to control so that time when '1' is output from the multi-input AND circuit 3 according to the strobe pulse STROBE1 is shorter than T1 and so that the energy of the heater of the thermal head according to the strobe pulse STROBE1 is equal.

Also, in case there is no print data at q2 and q3 when the corresponding print dot q1 shown in FIG. 6C is printed, these dots are '0', as the NAND circuits 19 and 20 both output '1', the AND circuit 6 and the multi-input AND circuit 4 both output '1', hereby, the OR circuit 2 turns on FET1 by defined time T2(T1>T2) according to a strobe pulse STROBE2 and the heater of the thermal head is heated.

However, in case there is print data at at least one of q2 and q3, '0' is output from the AND circuit 6 by time controlled according to a gate signal C1 and/or C2 according to the print data in the consideration of the effect of heat accumulation as described later so as to control so that time when '1' is output from the multi-input AND circuit 4 according to the strobe pulse STROBE2 is shorter than T2 and so that the energy of the heater of the thermal head according to the strobe pulse STROBE2 is equal.

As described above, as the print head can be energized on one scanning line by long and short plural types of strobe pulses, the print head can be also controlled by plural thermal energy by one printing scan on paper such as develops different colors for plural thermal energy and printing in plural colors is enabled by one printing scan.

Therefore, the same scanning line is not required to be scanned plural times by the number of colors as heretofore and printing in plural colors can be performed at high speed.

Referring to a control signal shown in FIG. 7, the operation of the control circuit shown in FIG. 6 will be described further in detail below.

Each control signal shown in FIG. 7 is output from a control signal output circuit not shown and is all output at the same cycle S.

Figures 7A, 7B:
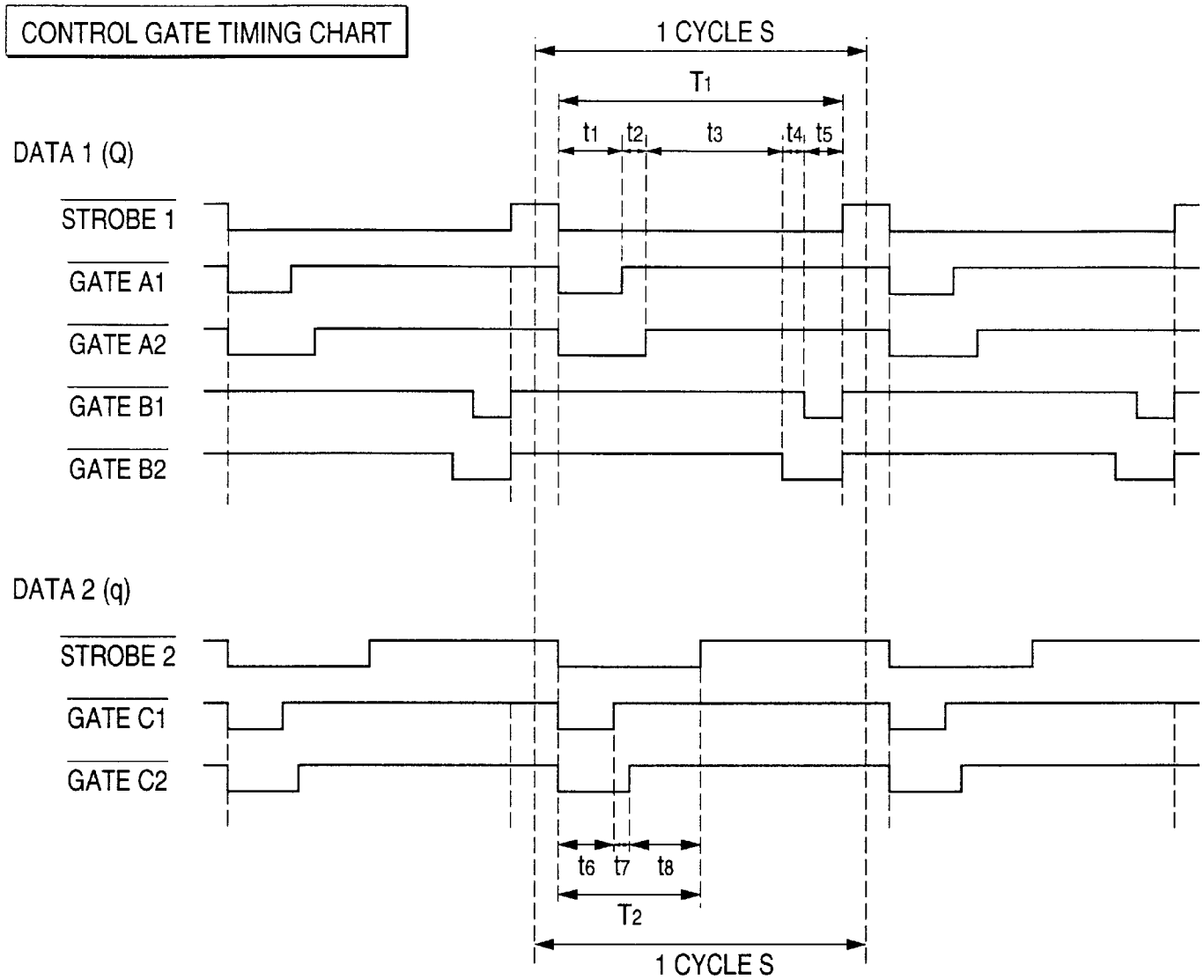
FIGS. 7A and 7B are explanatory drawings for explaining a control signal applied to the control circuit shown in FIGS. 6A to 6C.

Control signals shown in FIG. 7A are each type of control signal in case the thermal head is controlled in a high energy state and control signals shown in FIG. 7B are each type of control signal in case the thermal head is controlled in a low energy state.

A strobe pulse STROBE1 turns on FET1 by a period T1 in case only the corresponding print dot Q1 exists in a printing control range shown in FIG. 6B, controls so that the thermal head connected to FET1 is heated by the period T1 and is at a low level only in the period T1 as shown in FIG. 7A.

A signal GATE A1 becomes a low level at the same time as STROBE1 and becomes a high level in a period t1.

A signal GATE A2 becomes a low level at the same time as STROBE1 and becomes a high level in a period (t1+T2).

A signal GATE B1 becomes a low level in a period (t1+t2+t3+t4) after STROBE1 becomes a low level and then in a period t5, becomes a high level at the same time as STROBE1.

A signal GATE B2 becomes a low level in a period (t1+t2+t3) after STROBE1 becomes a low level and then in a period (t4+t5), becomes a high level at the same time as STROBE1.

A strobe pulse STROBE2 turns on FET1 by a period T2 in case only the corresponding print dot q1 exists in a printing control range shown in FIG. 6C, controls so that the thermal head connected to FET1 is heated by the period T2(T2 <T1), becomes a low level at the same time as STROBE1 as shown in FIG. 7B and is kept at a low level by the period T2.

A signal GATE C1 becomes a low level at the same time as STROBE2 and in a period t6, becomes a high level.

A signal GATE C2 becomes a low level at the same time as STROBE2 and in a period (t6+t7), becomes a high level.

T1, T2, t1 to t8 described above can be suitably set according to the characteristics of paper.

First, referring to FIGS. 6 and 7, as to thermal history control disclosed in Japanese Patent No. 302,728 described above, a case that print data exists at the print dots Q1 to Q3, LQ2 and RQ2 in the printing control range shown in FIGS. 6B and 6C, that is, in a high energy part and print data exists at the print dots q1 to q3 in a low energy part will be described.

In case Q1 is the corresponding print dot, Q2 shows a print dot before by one line and Q3 shows a print dot before by two lines. LQ2 shows a print dot on the left side before by one line and RQ2 shows a print dot on the right side before by one line.

In case q1 is the corresponding print dot, q2 shows a print dot before by one line and q3 shows a print dot before by two lines.

(1) Case that print data exists only at the print dot Q1

In case print data exists only at the corresponding print dot Q1 in the printing control range shown in FIG. 6B and no print data exists at Q2, Q3, LQ2 and RQ2, namely, Q1 is 1, Q2 is 0, Q3 is 0, LQ2 is 0 and RQ2 is 0 in FIG. 6A.

As the NAND circuits 7 to 10 respectively output '1' based upon each '0', the multi-input AND circuit 5 outputs '1'. At this time, in case the thermal head is normal, '1' is output from the output protection network 13, as Q1 is 1 and STROBE1 shown in FIG. 7A is transmitted to the inverter 14, '1' is output from the multi-input AND circuit 3 only for the period T1 shown in FIG. 7A. At this time, as q1 is 0, the multi-input AND circuit 4 outputs '0'.

As described above, as '1' output from the multi-input AND circuit 3 is input to FET1 via the OR circuit 2, the OR circuit 2 applies '1' to FET1 only for the period T1 after all and turns on FET1 in case print data exists at Q1 and no print data exists at Q2, Q3, LQ2 and RQ2, and controls the thermal head so that the heater connected to FET1 is heated only for the period T1.

(2) Case that print data exists at print dots Q1 and Q2

When print data exists at the corresponding print dot Q1 and the print dot Q2 before by one line, '1' is respectively applied to Q1 and Q2 in FIG. 6A and '0' is respectively applied to Q3, LQ2 and RQ2. Hereby, the NAND circuits 8 to 10 respectively output '1'.

At this time, as a signal acquired by inverting GATE A1 shown in FIG. 7A by the inverter 15 and '1' from Q2 are applied to the NAND circuit 7, the NAND circuit 7 outputs '0' only for the period t1 shown in FIG. 7 and outputs '1' for the other period. Therefore, the multi-input AND circuit 5 outputs '1' for a residual period (t2+t3+t4+t5) acquired by subtracting the period t1 from the period T1 shown in FIG. 7, FET1 is also turned on only for the period and controls so that the heater of the thermal head connected to FET1 is heated only for a period (T1−t1).

(3) Case that print data exists at print dots Q1 and Q2

When print data exists at the corresponding print dot Q1 and the print dot LQ2 adjacent to the dot before by one dot on the left side, '1' is respectively applied to Q1 and LQ2 shown in FIG. 6A and '0' is respectively applied to Q2, Q3 and RQ2. Hereby, the NAND circuits 7, 9 and 10 respectively output '1'.

At this time, '1' from LQ2 and output from the exclusive OR circuit 11 are input to the NAND circuit. As a signal acquired by inverting GATE A1 shown in FIG. 7A by the inverter 15 and a signal acquired by inverting GATE A2 shown in FIG. 7A by the inverter 16 are applied to the exclusive OR circuit 11, the exclusive OR circuit 11 outputs '1' only for the period t2 shown in FIG. 7 and outputs '0' for the other period. Therefore, the NAND circuit 8 outputs '0' only for the period t2 and outputs '1' for the other period.

Therefore, the multi-input AND circuit 3 outputs '1' for a residual period (t1+t3+t4+t5) acquired by subtracting the period t2 from the period T1 shown in FIG. 7, FET1 is also turned on only for the period and controls so that the heater of the thermal head connected to FET1 is heated only for a period (T1−t2).

(4) Case that print data exists at print dots Q1 and RQ2

When print data exists at the corresponding print dot Q1 and the print dot RQ2 adjacent to the dot before by one dot on the right side, '1' is respectively applied to Q1 and RQ2 shown in FIG. 6A and '0' is respectively applied to Q2, Q3 and LQ2. Hereby, the NAND circuits 7 to 9 respectively output '1'.

At this time, '1' from RQ2 and output from the exclusive OR circuit 12 are input to the NAND circuit 10. As a signal acquired by inverting GATE B1 shown in FIG. 7A by the inverter 17 and a signal acquired by inverting GATE B2 shown in FIG. 7A by the inverter 18 are applied to the exclusive OR circuit 12, the exclusive OR circuit 12 outputs 11 only for a period t4 shown in FIG. 7 and outputs '0' for the other period. Therefore, the NAND circuit 10 outputs '0' only for the period t4 and outputs '1' for the other period.

Therefore, the multi-input AND circuit 3 outputs '1' for a residual period (t1+t2+t3+t5) acquired by subtracting the period t4 from the period T1 shown in FIG. 7, FET1 is also turned on only for the period and controls so that the heater of the thermal head connected to FET1 is heated only for a period (T1−t4).

(5) Case that print data exists at print dots Q1 and Q3

When print data exists at the corresponding print dot Q1 and the print dot Q3 before by two dots, '1' is respectively applied to Q1 and Q3 shown in FIG. 6A and '0' is respectively applied to Q2, LQ2 and RQ2. Hereby, the NAND circuits 7, 8 and 10 respectively output '1'.

At this time, as '1' from Q3 and a signal acquired by inverting GATE B1 shown in FIG. 7A by the inverter 17 are applied to the NAND circuit 9, the NAND circuit 9 outputs '0' only for a period t5 shown in FIG. 7 and outputs '1' for the other period.

Therefore, the multi-input AND circuit 3 outputs '1' for a residual period (t1+t2+t3+t4) acquired by subtracting the period t5 from the period T1 shown in FIG. 7, FET1 is also turned on only for the period and controls so that the heater of the thermal head connected to FET1 is heated only for a period (T1−t5).

(6) Case that print data exists at print dots Q1, Q2 and Q3

When print data exists at the corresponding print dot Q1, the print dot Q2 before by one dot and the print dot Q3 before by two dots, '1' is respectively applied to Q1, Q2 and Q3 shown in FIG. 6A and'0' is respectively applied to LQ2 and RQ2. Hereby, the NAND circuits 8 and 10 respectively output '1'.

At this time, as '1' from Q2 and a signal acquired by inverting GATE A1 shown in FIG. 7A by the inverter 15 are applied to the NAND circuit 7, the NAND circuit 7 outputs '0' only for the period t1 shown in FIG. 7 and outputs '1' for the other period. Also, as '1' from Q3 and a signal acquired by inverting GATE B1 shown in FIG. 7A by the inverter 17 are applied to the NAND circuit 9, the NAND circuit 9 outputs '0' only for the period t5 shown in FIG. 7 and outputs '1' for the other period.

Therefore, the multi-input AND circuit 3 outputs '1' for a residual period (t2+t3+t4) acquired by subtracting the periods t1 and t5 from the period T1 shown in FIG. 7, FET1 is also turned on only for the period and controls so that the heater of the thermal head connected to FET1 is heated only for a period (T1−t1−t5).

(7) Case that print data exists at print dot Q1 and plural print dots of print dots Q2, Q3, LQ2 and RQ2

When print data exists at the corresponding print dot Q1 and plural dots, for example Q2 and LQ2 of the print dots Q2, Q3, LQ2 and RQ2, the NAND circuits 9 and 10 respectively output '1' because Q3 and RQ2 are both 0.

At this time, as a signal acquired by inverting GATE A1 shown in FIG. 7A by the inverter 15 as described in (2) and '1' from Q2 are applied to the NAND circuit 7, the NAND circuit 7 outputs '0' only for the period t1 shown in FIG. 7.

Also, '1' from LQ2 and output from the exclusive OR circuit 11 are input to the NAND circuit 8 as described in (3). As a signal acquired by inverting GATE A1 shown in FIG. 7A by the inverter 15 and a signal acquired by inverting GATE A2 shown in FIG. 7A by the inverter 16 are applied to the exclusive OR circuit 11, the exclusive OR circuit 11 outputs '1' only for the period t2 shown in FIG. 7 and outputs '0' for the other period. Therefore, the NAND circuit 8 outputs '0' only for the period t2.

Therefore, when print data exists at Q2 and LQ2, the multi-input AND circuit 5 outputs '0' only for a period (t1+t2) acquired by adding the period t1 in which the multi-input AND circuit 5 outputs '0' when data exists at the corresponding print dot Q1 and the print dot Q2 and the period t2 in which the multi-input AND circuit 5 outputs '0' when data exists at the corresponding print dot Q1 and the print dot LQ2 and controls so that the heater of the thermal head connected to FET1 is heated only for a period (T1−t1−t2).

That is, when print data exists at the corresponding print dot Q1 and plural print dots of the print dots Q2, Q3, LQ2 and RQ2, the multi-input AND circuit 5 outputs '0' by the sum of the periods when '0' is output described in (2) to (5) from the multi-input AND circuit 5 according to the other print dots when data exists at the corresponding print dot Q1 and the print dot of the other print dots Q2, Q3, LQ2 and RQ2 and the heater of the thermal head connected to FET1 is heated for a period acquired by subtracting the period of the sum from T1.

For example, when print data exists at all of Q1, Q2, Q3, LQ2 and RQ2, the multi-input AND circuit 5 outputs '1' only for a period T1−(t1+t2+t4+t5)=t3 and the heater of the thermal head connected to FET1 is heated only for the period t3.

(8) Case that print data exists at only print dot q1

In case print data exists at only the corresponding print dot q1 and no print data exists at q2 and q3 in the printing control range shown in FIG. 6C, q1 is 1 and q2 and q3 are 0 in FIG. 6A.

Therefore, as '1' is respectively output from the NAND circuits 19 and 20 because q2 and q3 are both 0, the multi-input NAND circuit 6 outputs '1'. At this time, in case the thermal head is normal, '1' is output from the output protection network 13. At this time, as q1 is 1 and STROBE2 shown in FIG. 7B is transmitted to the inverter 22, '1' is output from the multi-input AND circuit 4 only for the period T2 shown in FIG. 7B. At this time, as Q1 is 0, the multi-input AND circuit 3 outputs '0'.

As described above, as '1' output from the multi-input AND circuit 4 is input to FET1 via the OR circuit 2, the OR circuit 2 applies '1' to FET1 only for the period T2(T2<T1) after all in case print data exists at q1 and no print data exists at q2 and q3, turns on FET1 and FET1 controls so that the heater of the thermal head connected to FET1 is heated only for the period T2.

(9) Case that print data exists at print dots q1 and q2

When print data exists at the corresponding print dot q1 and the print dot q2 before by one line, '1' is respectively applied to q1 and q2 in FIG. 6A and '0' is applied to q3. Hereby, the NAND circuit 20 outputs '1'.

At this time, as a signal acquired by inverting GATE C1 shown in FIG. 7B by the inverter 23 and '1' from q2 are applied to the NAND circuit 19, the NAND circuit 19 outputs '0' only for a period t6 shown in FIG. 7 and outputs '1' for the other period. Therefore, as the AND circuit 6 outputs '1' for a residual period (t7+t8) acquired by subtracting the period t6 from the period T2 shown in FIG. 7 and the multi-input AND circuit 4 and the OR circuit 2 also outputs '1' only for the period (t7+t8), FET1 is also turned on only for the period and controls so that the heater of the thermal head connected to FET1 is heated only for a period (T2−t6).

(10) Case that print data exists at print dots q1 and q3

When print data exists at the corresponding print dot q1 and the print dot q3 before by two dots, '1' is respectively applied to q1 and q3 in FIG. 6A and '0' is applied to q2. Hereby, the NAND circuit 19 outputs '1'.

At this time, '1' from q3 and output from the exclusive OR circuit 21 are input to the NAND circuit 20. As a signal acquired by inverting GATE C1 shown in FIG. 7B by the inverter 23 and a signal acquired by inverting GATE C2 shown in FIG. 7B by the inverter 24 are applied to the exclusive OR circuit 21, the exclusive OR circuit 21 outputs '1' only for a period t7 shown in FIG. 7 in which '1' and '0' of both signals do not accord and outputs '0' for the other period. Therefore, the NAND circuit 20 outputs '0' only for the period t7 and outputs '1' for the other period.

Therefore, as the AND circuit 6 outputs '1' for a residual period (t6+t8) acquired by subtracting the period t7 from the period T2 shown in FIG. 7 and the multi-input AND circuit 4 and the OR circuit 2 also output '1' only for the period (t6+t8), FET1 is also turned on only for the period and controls so that the heater of the thermal head connected to FET1 is heated only for a period (T2−t7).

(11) Case that print data exists at print dots q1, q2 and q3

When print data exists at any of the corresponding print dot q1, the print dot q2 before by one dot and the print dot q3 before by two dots, '1' is respectively applied to q1, q2 and q3 shown in FIG. 6A.

At this time, as described in (9), as a signal acquired by inverting GATE C1 shown in FIG. 7B by the inverter 23 and '1' from q2 are applied to the AND circuit 19, the NAND circuit 19 outputs '0' only for the period t6 shown in FIG. 7.

Also, as described in (10), '1' from q3 and output from the exclusive OR circuit 21 are input to the NAND circuit 20. At this time, as a signal acquired by inverting GATE C1 shown in FIG. 7B by the inverter 23 and a signal acquired by inverting GATE C2 shown in FIG. 7B by the inverter 24 are applied to the exclusive OR circuit 21, the exclusive OR circuit 21 outputs '1' only for the period t7 shown in FIG. 7 in which '1' and '0' of both signals do not accord and outputs '0' for the other period. Therefore, the NAND circuit 20 outputs '0' only for the period t7 and outputs '1' for the other period.

Therefore, as the AND circuit 6 outputs '1' for a residual period t8 acquired by subtracting the periods t6 and t7 from the period T2 shown in FIG. 7 and the multi-input AND circuit 4 and the OR circuit 2 also output '1' only for the period t8, FET1 is also turned on only for the period t8=T2−(t6+t7) and controls so that the heater of the thermal head connected to FET1 is heated only for the period T2−(t6+t7).

As described above, the data of a high energy part and the data of a low energy part can be arbitrarily output by the heater of the thermal head. For example, the printing data of the high energy part in black on plural-color thermosensitive paper and the printing data of the low energy part in red can be controlled.

Second Embodiment

In such a control circuit, control over the data of the high energy part and control over the data of the low energy part are independently performed. Therefore, in case such two types of input energy data exist, for example, in case the data of the high energy part, that is, the print dots Q2 and Q3 exist in the positions of the print dots q2 and q3 shown in FIG. 6C, the print dot q1 cannot be printed by low energy because of its effect and the result of printing is close to that of the data of high energy. For example, data to be printed in red is printed in black.

A thermal head according to the second embodiment in that data to be printed by high energy in the vicinity of data to be printed by low energy was prevented from having an effect upon data to be printed by low energy is disclosed hereinafter.

Next, referring to FIGS. 8 to 10, the second embodiment will be described. FIG. 8 shows a control circuit per one dot of a thermal head in an example in which print data before a high energy part is added to a controlled range, FIG. 9 is an explanatory drawing for explaining a control signal applied to the control circuit and FIG. 10 is a block diagram showing a printing control circuit.

A diode 30 connects the signal input circuit of the print dot Q2 in a high energy part and the signal input circuit of the print dot q2 in a low energy part. Hereby, the similar control to a case that print data exists at the print dot q2 in the low energy part when print data exists at the print dot Q2 in the high energy part is executed.

A diode 31 connects the signal input circuit of the print dot Q3 in a high energy part and the signal input circuit of the print dot q3 in a low energy part. Hereby, the similar control to a case that print data exists at the print dot q3 in the low energy part when print data exists at the print dot Q3 in the high energy part is executed.

Figure 8A:
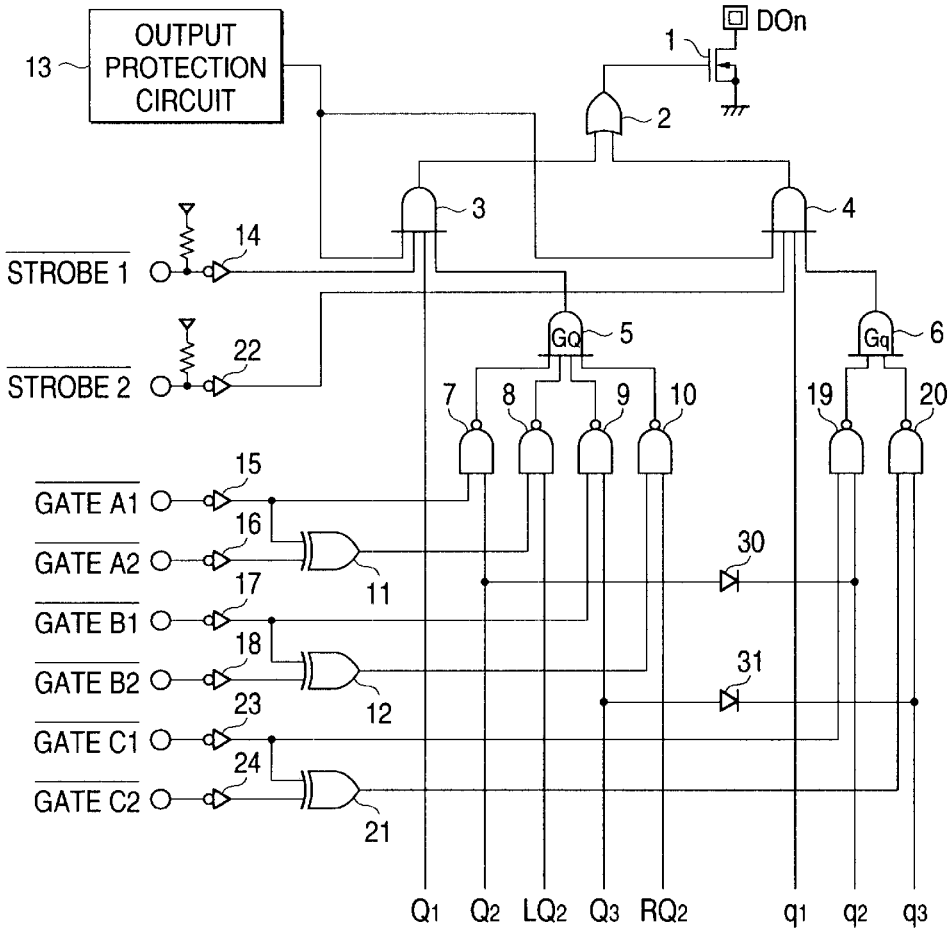
FIGS. 8A to 8C show a control circuit per dot of a thermal head according to a second embodiment.
Figure 8B:
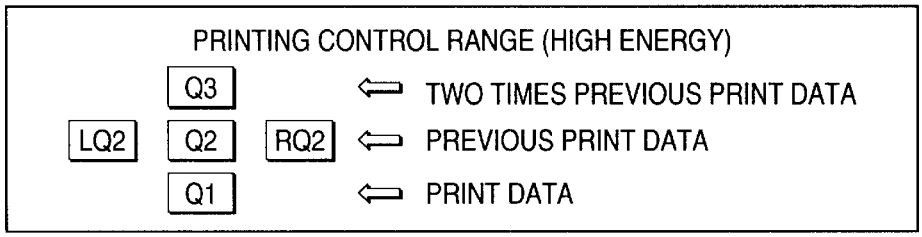
Figure 8C:
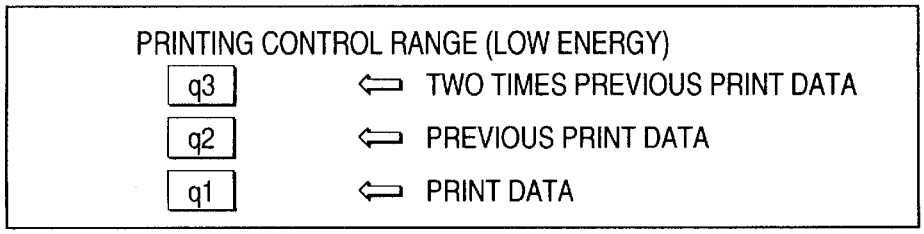
Figures 9A, 9B:
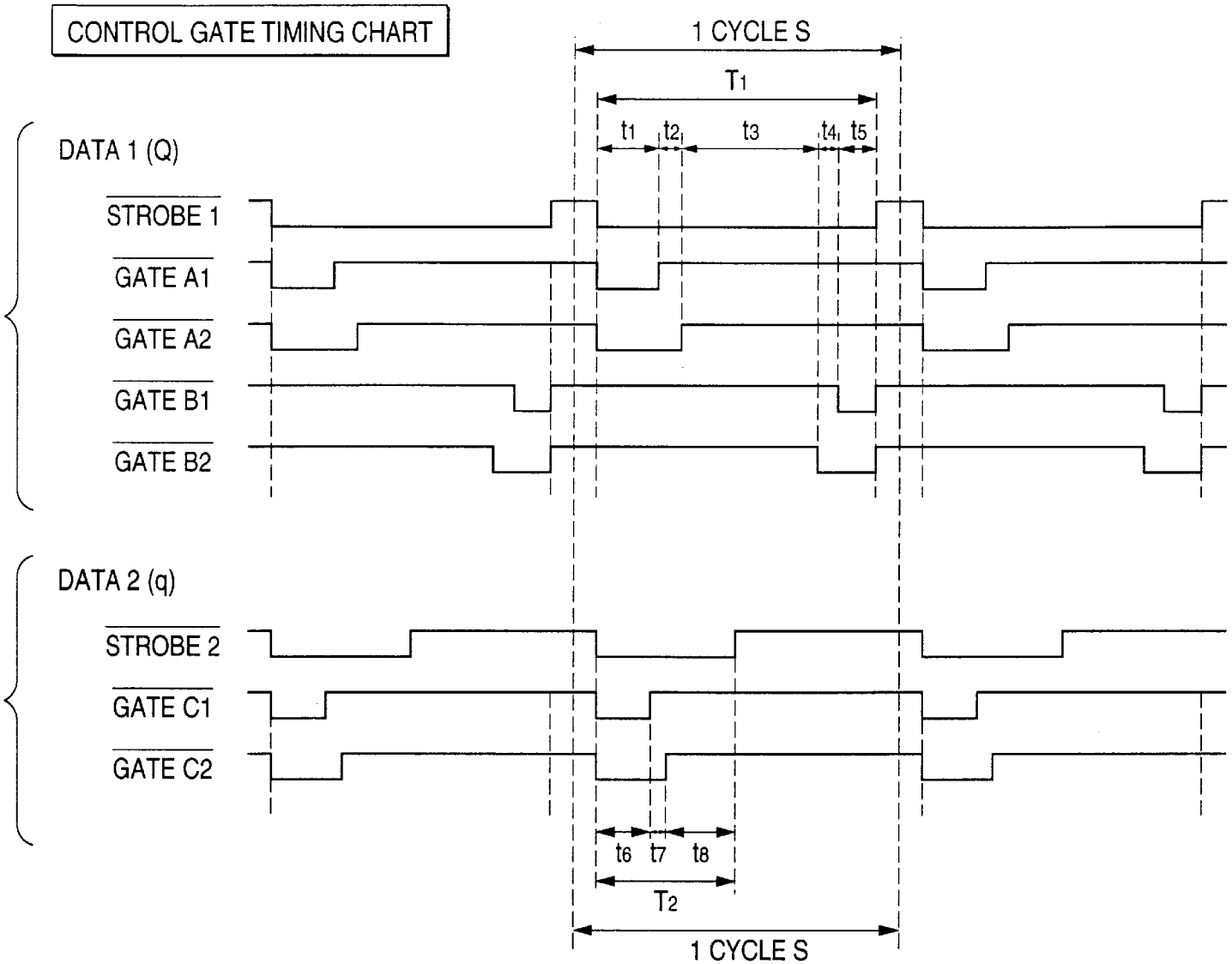
FIGS. 9A and 9B are explanatory drawings for explaining a control signal applied to the control circuit shown in FIGS. 8A to 8C.
Figure 10:
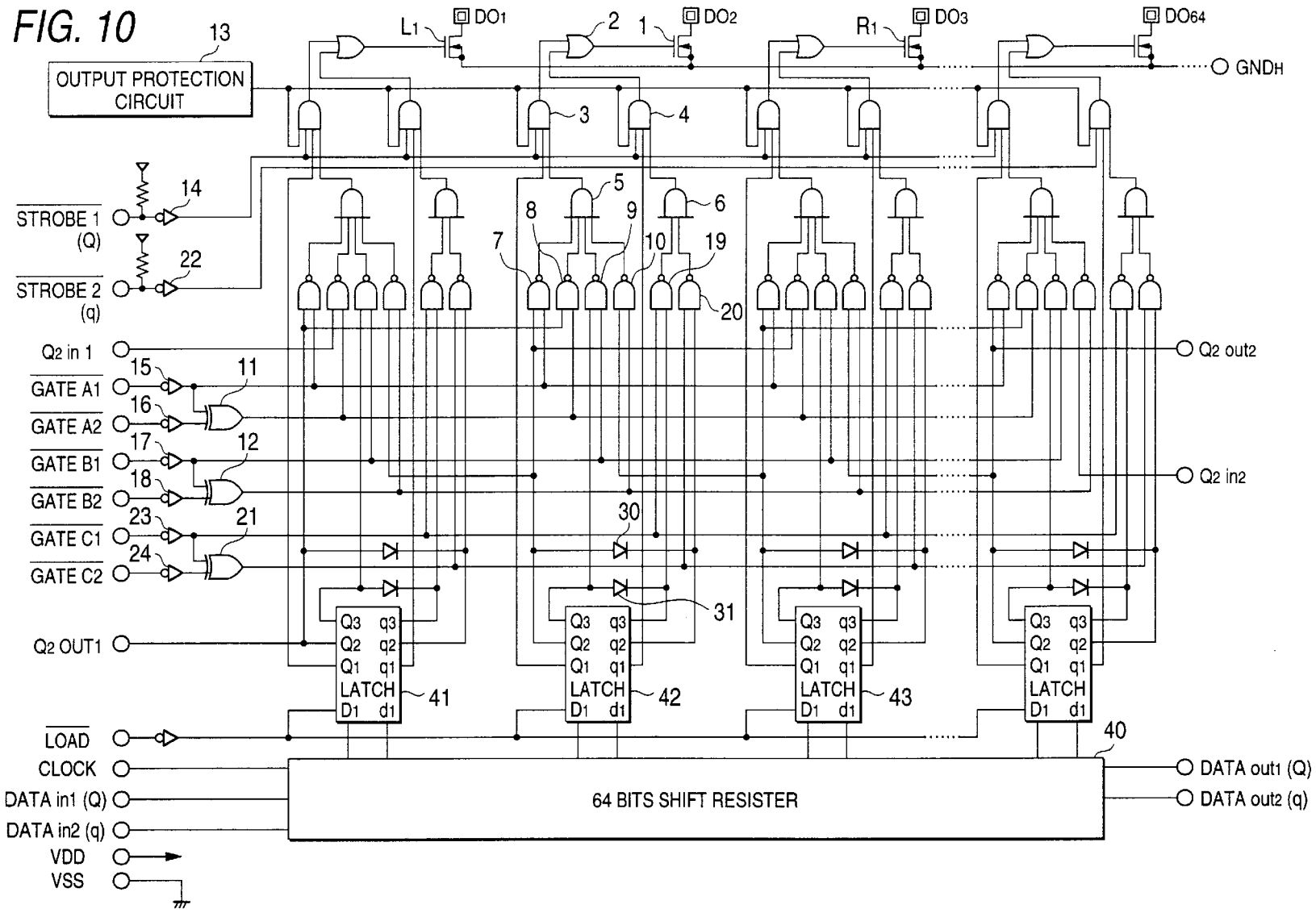
FIG. 10 is a block diagram showing a printing control circuit according to the second embodiment.

FIG. 8 shows the same configuration as that of the control circuit shown in FIG. 6A except the diodes 30 and 31 and FIGS. 9A and 9B shows the same pattern as FIGS. 7A and 7B. Therefore, as for a control circuit shown in FIG. 8, as independent control over a high energy part is the same as control over the high energy part shown in FIG. 6A and independent control over a low energy part is the same as control over the low energy part shown in FIG. 6A, the description of the control described above is omitted.

Operation for control in a case that print data exists at q1 in a low energy part, no print data exists at q2 or q3 in the low energy part and print data exists at Q2 or Q3 in a high energy part will be described below. Print data is generated so that the coexistence of the print data of a high energy part and the print data of a low energy part in the same dot is avoided.

(1) Case that print data exists at print dots q1 and Q2

In case print data exists only at the corresponding print dot q1, no print data exists at q2 and q3, print data exists at the print dot Q2 in a high energy part shown in FIG. 8B and not print data exists at Q3 in the printing control range of a low energy part shown in FIG. 8C, q1 is 1, q2 is 0, q3 is 0, Q2 is 1 and Q3 is 0 in FIG. 8A.

At this time, as q3 is 0, the NAND circuit 20 outputs '1'.

However, in the NAND circuit 19, though q2 is 0, '1' is input to the signal input circuit of q2 from Q2 via the diode 30. Further, as a signal acquired by inverting GATE C1 shown in FIG. 9B by the inverter 23 is applied to the NAND circuit 19, the NAND circuit 19 outputs '0' only for the period t6 shown in FIG. 9 and outputs '1' for the other period.

Therefore, as the AND circuit 6 outputs '1' for a residual period (t7+t8) acquired by subtracting the period t6 from the period T2 according to STROBE2 and shown in FIG. 9 and the multi-input AND circuit 4 and the OR circuit also output '1' only for the period (t7+t8), FET1 is also turned on only for the period and controls so that the heater of the thermal head connected to FET1 is heated only for a period (T2−t6).

The effect of heat receive at the print dot Q2 in a high energy part upon the corresponding print dot q1 can be prevented by reducing heating time by the period t6 as described above.

(2) Case that print data exists at print dots q1 and Q3

In case print data exists only at the corresponding print dot q1, no print data exists at q2 and q3, print data exists at the print dot Q3 in the high energy part shown in FIG. 8B and no print data exists at Q2 in the printing control range of the low energy part shown in FIG. 8C, q1 is 1, q2 is 0, q3 is 0, Q2 is 0 and Q3 is 1 in FIG. 8A.

At this time, the NAND circuit 19 outputs '1' because q2 is 0. However, in the NAND circuit 20, though q3 is 0, '1' is input to the signal input circuit of q3 from Q3 via the diode 31. Further, the output of the exclusive OR circuit 21 is input to the NAND circuit 20. At this time, as a signal acquired by inverting GATE C1 shown in FIG. 9B by the inverter 23 and a signal acquired by inverting GATE C2 shown in FIG. 9B by the inverter 24 are applied to the exclusive OR circuit 21, the exclusive OR circuit 21 outputs '1' only for the period t7 shown in FIG. 9 in which '1' and '0' of both signals do not accord and outputs '0' for the other period. Therefore, the NAND circuit 20 outputs '0' only for the period t7 and outputs '1' for the other period.

Therefore, as the AND circuit 6 outputs '1' for a residual period (t6+t8) acquired by subtracting the period t7 from the period T2 according to STROBE2 shown in FIG. 9 and the multi-input AND circuit 4 and the OR circuit 2 also output '1' only for the period (t6+t8), FET1 is also turned on only for the period and controls so that the heater of the thermal head connected to FET1 is heated only for a period (T2−t7).

The effect of heat receive at the print dot Q3 in a high energy part upon the corresponding print dot q1 can be prevented by reducing heating time by the period t7 as described above.

(3) Case that print data exists at print dots q1, Q2 and Q3

In case print data exists only at the corresponding print dot q1, no print data exists at q2 and q3 and print data exists at the print dots Q2 and Q3 in the high energy part shown in FIG. 8B in the printing control range of the low energy part shown in FIG. 8C, q1 is 1, q2 is 0, q3 is 0, Q2 is 0 and Q3 is 0 in FIG. 8A.

At this time, in the NAND circuit 19, though q2 is 0, '1' is input to the signal input circuit of q2 from Q2 via the diode 30. Further, as a signal acquired by inverting GATE C1 shown in FIG. 9B by the inverter 23 is applied to the NAND circuit 19, the NAND circuit 19 outputs '0' only for the period t6 shown in FIG. 9 and outputs '1' for the other period.

In the NAND circuit 20, though q3 is 0, '1' is input to the signal input circuit of q3 from Q3 via the diode 31. The output of the exclusive OR circuit 21 is input to the NAND circuit 20, however, as described above, the exclusive OR circuit 21 outputs '1' only for the period t7 shown in FIG. 9 in which '1' and '0' of a signal acquired by inverting GATE C1 and a signal acquired by inverting GATE C2 do not accord and outputs '0' for the other period. Therefore, the NAND circuit 20 outputs '0' for the period t7 shown in FIG. 9 and outputs '1' for the other period.

Therefore, as the AND circuit 6 outputs '1' only for the residual period t8 acquired by subtracting the period (t6+t7) from the period T2 according to STROBE2 shown in FIG. 9, FET1 is also turned on only for the period t8=T2−(t6+t7) and controls so that the heater of the thermal head connected to FET1 is heated only for the period t8.

The effect of heat receive at the print dots Q2 and Q3 in a high energy part upon the corresponding print dot q1 can be prevented by reducing heating time by the period (t6+t7) as described above.

(4) Case that print data exists at print dots q1, q2 and Q3

In case print data exists at the corresponding print dot q1 and the print dot q2, no print data exists at q3, print data exists at the print dot Q3 in the high energy part shown in FIG. 8B and no print data exists at Q2 in the printing control range of the low energy part shown in FIG. 8C, q1 is 1, q2 is 1, q3 is 0, Q2 is 0 and Q3 is 1 in FIG. 8A.

In this case, the similar control is executed to that in (3) and FET1 is turned on only for the period t8=T2−(t6+t7).

The effect of heat receive at not only the print dot q2 in a low energy part but the print dot Q3 in a high energy part upon the corresponding print dot q1 can be prevented by reducing heating time by the period (t6+t7) as described above.

(5) Case that print data exists at print dots q1, q3 and Q2

In case print data exists at the corresponding print dot q1 and the print dot q3, no print data exists at q2, print data exists at the print dot Q2 in the high energy part shown in FIG. 8B and no print data exists at Q3 in the printing control range of the low energy part shown in FIG. 8C, q1 is 1, q2 is 0, q3 is 1, Q2 is 1 and Q3 is 0 in FIG. 8A.

In this case, the similar control is executed to that in (3) and FET1 is turned on only for the period t8=T2−(t6+t7).

The effect of heat receive at not only the print dot q3 in a low energy part but the print dot Q2 in a high energy part upon the corresponding print dot q1 can be prevented by reducing heating time by the period (t6+t7) as described above.

Referring to FIG. 10 and other drawings, the configuration of a printing control circuit provided with such a control circuit will be described below. FIG. 10 shows an example in which a print head for 64 bits is controlled and the same reference number is allocated to the same part as that in other drawings. In FIG. 10, FET1 controls printing at the corresponding print dot Q1 described in relation to FIG. 8A, L1 denotes FET for controlling printing at a print dot on the left side of the corresponding print dot Q1, R1 denotes FET for controlling printing at a print dot on the right side of the corresponding print dot Q1, VSS denotes a grounding signal and VDD denotes the power supply voltage of a control system.

A reference number 40 denotes a shift register and it is composed of a 64-bit first shift register not shown to which the print data of a high energy part Q is input and a 64-bit second shift register not shown to which the print data of a low energy part q is input. In this example, the 64-bit input data of the high energy part Q is serially input to the first shift register via DATAin1 (Q) according to a clock pulse, the 64-bit input data of the low energy part q is serially input to the second shift register via DATAin2 (q) and are respectively serially output to the next element for example via DATAout1 (Q) and DATAout2 (q). Reference numbers 41, 42, 43, - - - denote a register for storing the 3-bit print data of the high energy part Q and the 3-bit print data of the low energy part q.

The register for storing data 41 stores 1-bit print data transmitted to an input terminal D1 according to LOAD signal by serial 3 lines and stores 1-bit print data similarly transmitted to an input terminal d1 by serial 3 lines. The registers for data-hold 42, 43, - - - are also similar.

For example, when LOAD signal is input to each LATCh terminal of the registers for data-hold 41, 42, 43, - - - after a first print data line for the high energy part is input to the first shift register of the shift register 40 and a first print data line for the low energy part is input to the second shift register of the shift register 40, data transmitted to the input terminal D1 to which data at a first bit of the first shift register is transmitted is held in the register for data-hold 41 and is output from its terminal Q1, data transmitted to the input terminal d1 to which data at a first bit of the second shift register is transmitted is also held in the register for data-hold 41 and is output from its terminal q1.

Similarly, data at each second bit of the first shift register and the second shift register is output from the output terminals Q1 and q1 of the register for data-hold 42 and data at each third bit of the first shift register and the second shift register is output from the output terminals Q1 and q1 of the register for data-hold 43.

Next, when LOAD signal is input to each LATCH terminal of the registers for data-hold 41, 42, 43, - - - after a second print data line for the high energy part is input to the first shift register of the shift register 40 and a second print data line for the low energy part is input to the second shift register of the shift register 40, data at a new first bit of the first shift register is transmitted to the input terminal D1, is held in the register for data-hold 41 and is output from its output terminal Q1, data output from the output terminal Q1 till then is shifted to the next element and is output from the output terminal Q2. The similar control is executed for the second shift register, data at a new first bit of the second shift register is transmitted to the input terminal d1, is held in the register for data-hold 41 and is output from the terminal q1, data output from the output terminal q1 till then is shifted to the next element and is output from the output terminal q2.

Similarly, data at each second bit of the first shift register and the second shift register is output from the output terminals Q1 and q1 of the register for data-hold 42 and data respectively output from the output terminals Q1 and q1 till then are shifted to the next element and are output from the output terminals Q2 and q2.

The similar control is also executed in the register for data-hold 43, data at each third bit of the first shift register and the second shift register is output from the output terminals Q1 and q1 of the register for data-hold 43 and data respectively output from the output terminals Q1 and q1 till then are shifted to the next element and are output from the output terminals Q2 and q2.

When LOAD signal is input to each LATCH terminal of the registers for data-hold 41, 42, 43, - - - after a third print data line for the high energy part is input to the first shift register of the shift register 40 and a third print data line for the low energy part is input to the second shift register of the shift register 40, the similar control is executed, in the register for data-hold 41, data at a new first bit of the first shift register is output from the output terminal Q1, data respectively output from the output terminals Q1 and Q2 till then are shifted to the next element and are respectively output from the output terminals Q2 and Q3. Data at a new first bit of the second shift register is output from the terminal q1, data respectively output from the output terminals q1 and q2 till then are shifted to the next element and are respectively output from the output terminals q2 and q3.

Similarly in the register for data-hold 42, data at a new second bit of the first shift register is output from the output terminal Q1, data respectively output from the output terminals Q1 and Q2 till then are shifted to the next element and are respectively output from the output terminals Q2 and Q3. Also, data at a new second bit of the second shift register is output from the output terminal q1, data respectively output from the output terminals q1 and q2 till then are shifted to the next element and are respectively output from the output terminals q2 and q3.

Also, the output terminal Q2 is connected to the output terminal q2 via the diode 30 and the output terminal Q3 is connected to the output terminal q3 via the diode 31.

Further, similarly in the register for data-hold 43, data at a new third bit of the first shift register is output from the output terminal Q1, data respectively output from the output terminals Q1 and Q2 till then are shifted to the next element and are respectively output from the output terminals Q2 and Q3. Also, data at a new third bit of the second shift register is output from the output terminal q1, data respectively output from the output terminals q1 and q2 till then are shifted to the next element and are respectively output from the output terminals q2 and q3.

The first print data line is equivalent to the print line before by two lines shown in FIGS. 8B and 8C, the second print data line is equivalent to the print line before by one line and the third print data line is equivalent to the corresponding print line.

Output from the output terminal Q2 of the register 41 is input to the NAND circuit 8 (equivalent to LQ2 in FIG. 8A) and output from the output terminal Q2 of the register 43 is input to the NAND circuit 10 (equivalent to RQ2 in FIG. 8A). As described above, the similar control circuit based upon output from the registers for data-hold 41, 42 and 43 to that shown in FIG. 8A is configured.

Therefore, control based upon STROBE1 and STROBE2 respectively including heat history control according to the state of each print dot in the printing control range shown in FIGS. 8B and 8C is executed for FET1. The control is also similarly executed for FET 11, FET R1, - - - .

Figure 5A:
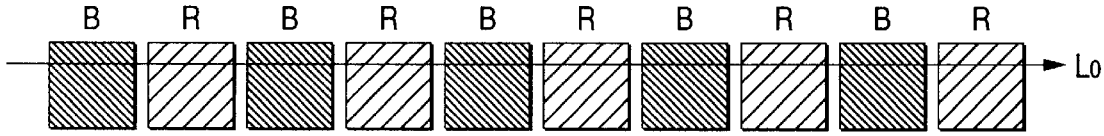
FIGS. 5A and 5B are explanatory drawings for explaining multi-color printing.
Figure 5B:
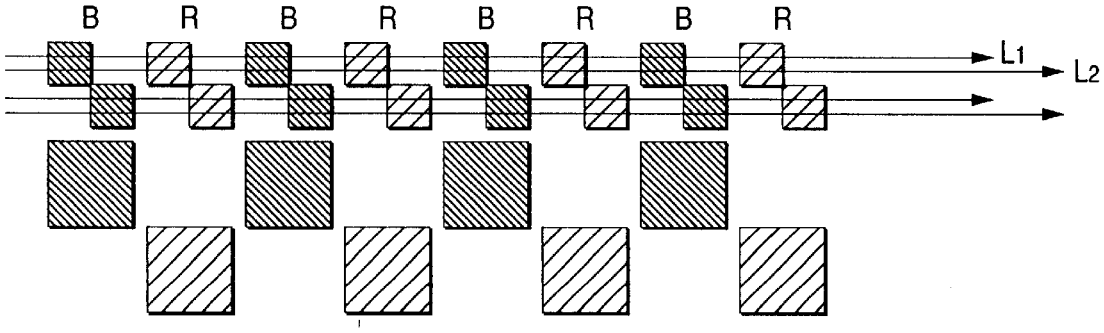

Therefore, when the print data of a high energy part is input to the first shift register of the shift register 40, the print data of a low energy part is input to the second shift register, a control signal such as STROBE1, STROBE2, GATE A1, GATE A2, GATE B1, GATE B2, GATE C1 and GATE C2 is input, control also over the printing control range as described above and control for preventing heat receive in the high energy part from having an effect upon the low energy part are executed at the same time as control for printing over the print data of the high energy part and the print data of the low energy part and plural-color printing shown in FIG. 5 for example is precisely performed by one scanning.

Next, referring to FIGS. 11 and 12, a second example of a control circuit per one dot of a thermal head according to the second embodiment will be described. FIG. 11 shows an example in which the print data of a high energy part before the corresponding print dot and adjacent data are added to the control range and FIG. 12 is an explanatory drawing for explaining control signals applied to the control circuit.

Figure 11A:
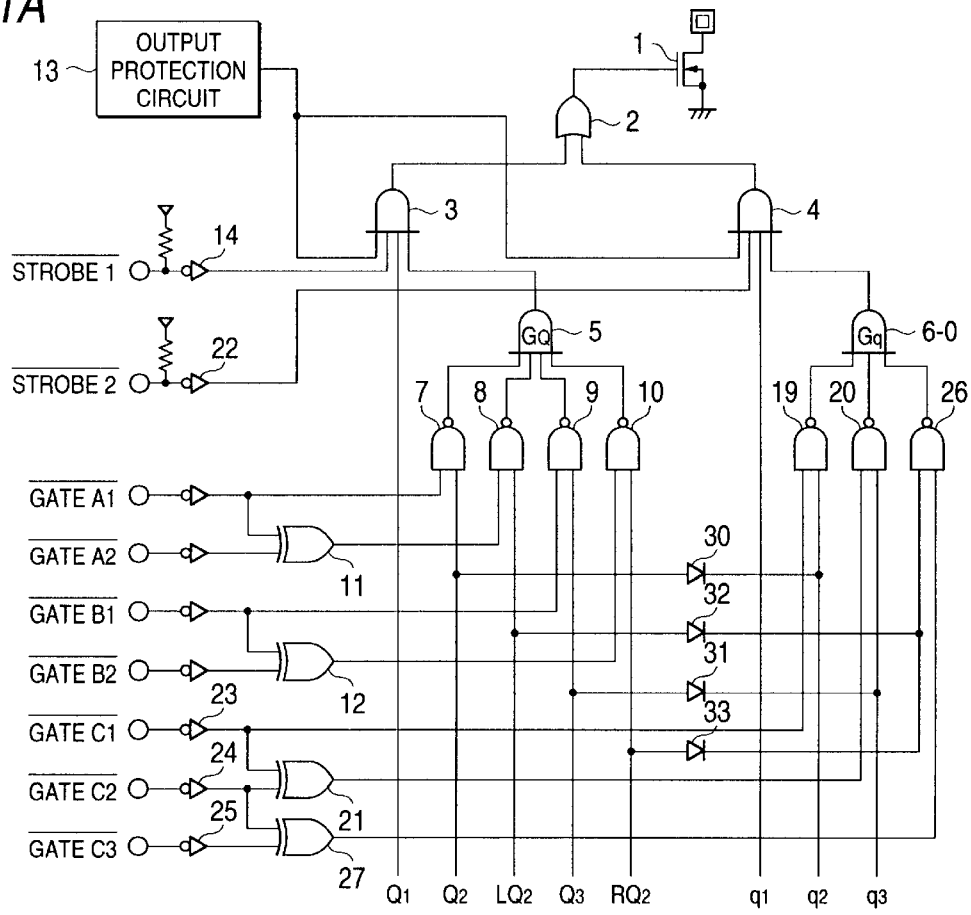
FIGS. 11A to 11D show a second example of a control circuit per dot of the thermal head according to the second embodiment.
Figure 11B:
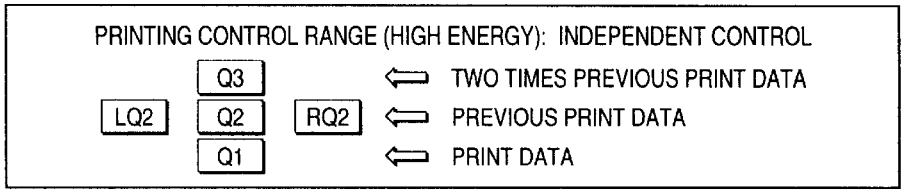

Assuming that a line including the corresponding print dot Q1 is the corresponding print line, a control circuit shown in FIG. 11A has a printing control range including a print dot Q2 immediately before the corresponding print dot, its left and right print dots LQ2 and RQ2 respectively on a print line immediately before the corresponding print line and further, a print dot Q3 before the corresponding print dot on a print line before by two lines in the independent control of a high energy part as shown in FIG. 11B.

Figure 11C:
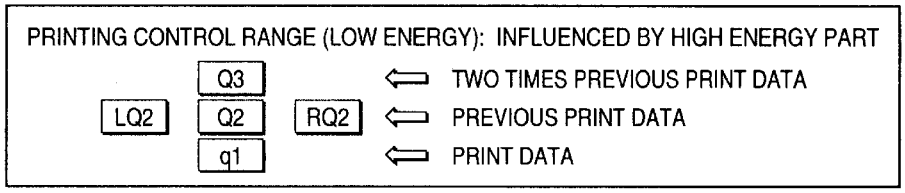
Figure 11D:
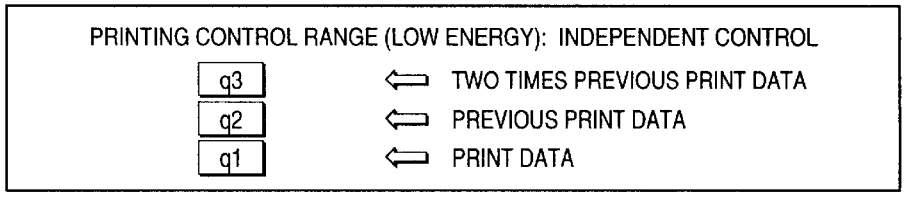

Also, in the independent control of a low energy part, as shown in FIG. 11D, assuming that a line including the corresponding print dot q1 is the corresponding print line, the control circuit has a printing control range including a print dot q2 before the corresponding print dot on a print line immediately before the corresponding print line and further, a print dot q3 before the corresponding print dot on a print line before by two lines.

In this example, a range of an effect of a high energy part upon the corresponding print dot q1 in a low energy part is defined as the print dots Q2 and Q3 and adjacent print dots LQ2 and RQ2 on the print line immediately before as shown in FIG. 11C.

Therefore, as shown in FIG. 11A, diodes 30, 31, 32 and 33, an inverter 25 and a NAND circuit 26 and an exclusive OR circuit 27 are provided.

Figures 12A, 12B:
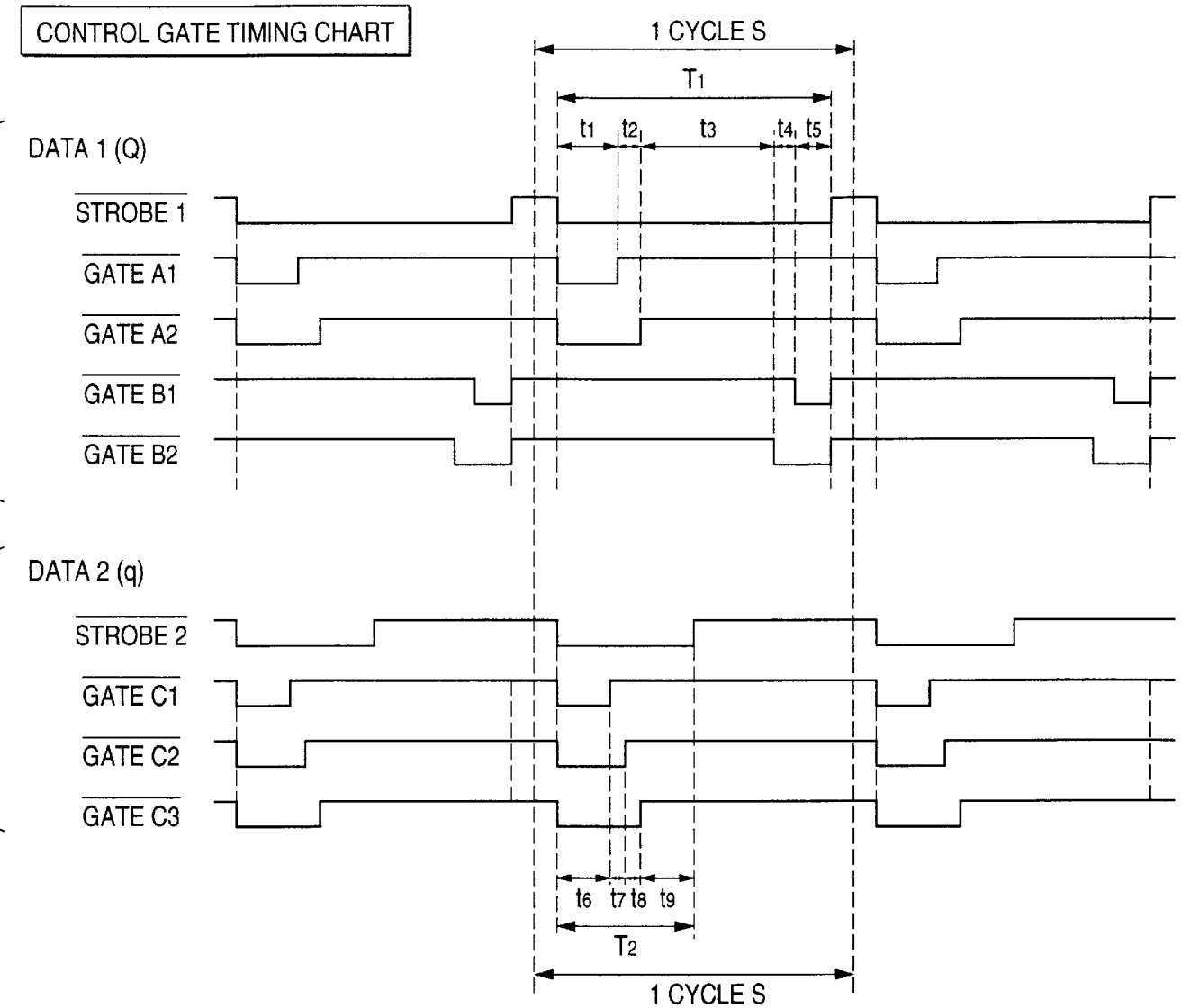
FIGS. 12A and 12B are explanatory drawings for explaining a control signal applied to the control circuit shown in FIGS. 11A to 11D.

A signal GATE C3 becomes a low level as the same time as STROBE2 as shown in FIG. 12B and becomes a high level in a period (t6+t7+t8). Needless to say, the period (t6+t7+t8) can be suitably set according to the characteristics of paper.

The diodes 30 and 31 are similar to those in the control circuit shown in FIG. 8A.

The diode 32 is provided to control the effect of a high energy part when print data exists at the print dot LQ2 in the high energy part and connects the signal input circuit of the print dot LQ2 in the high energy part and a circuit for inputting to the NAND circuit 26.

The diode 33 is provided to control the effect of a high energy part when print data exists at the print dot RQ2 in the high energy part and connects the signal input circuit of the print dot RQ2 in the high energy part and a circuit for inputting to the NAND circuit 26.

The output of the exclusive OR circuit 27 is input to the other input circuit of the NAND circuit 26.

A signal acquired by inverting GATE C2 and a signal acquired by inverting GATE C3 are input to the exclusive OR circuit 27.

As shown in FIG. 11A, as to the independent control of a high energy part, the same operation as the operation of the control circuit shown in FIG. 6A is executed. Also, as for the independent control of a low energy part, the NAND circuit 26 outputs '1' to a multi-input AND circuit 6-0 because LQ2 and RQ2 are both 0. Except it, the same operation as the operation of the control circuit shown in FIG. 6A is executed. Therefore, the description of the individual operation is omitted for simplification.

Typical control over the corresponding print dot q1 in a low energy part in case print data exists at LQ2 and RQ2 shown in FIG. 11C will be described below.

(1) Case that print data exists at print dots q1 and LQ2

In a printing control range of a low energy part shown in FIG. 11D, in case print data exists only at the corresponding print dot q1, no print data exists at q2 and q3, print data exists at the print dot LQ2 in a high energy part shown in FIG. 11C and no print data exists at Q2, Q3 and RQ2, q1 is 1, q2 is 0, q3 is 0, Q2 is 0, Q3 is 0, LQ2 is 1 and RQ2 is 0 in FIG. 11A.

At this time, the NAND circuit 19 outputs '1' because q2 is 0 and Q2 is 0 and the NAND circuit 20 outputs '1' because q3 is 0 and Q3 is 0.

Also, '1' is applied to one input circuit of the NAND circuit 26 because LQ2 is 1 and the output of the exclusive OR circuit 27 is input to the other input circuit. At this time, as a signal acquired by inverting GATE C2 shown in FIG. 12B by the inverter 24 and a signal acquired by inverting GATE C3 shown in FIG. 12B by the inverter 25 are applied to the exclusive OR circuit 27, the exclusive OR circuit 27 outputs '1' only for a period t8 shown in FIG. 12B in which '1' and '0' of both signals do not accord and outputs '0' for the other period. Therefore, the NAND circuit 26 outputs '0' only for the period t8 and outputs '1' for the other period.

Therefore, as the multi-input AND circuit 6-0 outputs '1' for a residual period (t6+t7+t8) acquired by subtracting the period t8 from a period T2 according to STROBE2 shown in FIG. 12 and a multi-input AND circuit 4 and an OR circuit 2 also output '1' only for the period (t6+t7+t8)=T2−t8, FET1 is also turned on only for the period and controls so that the heater of the thermal head connected to FET1 is heated only for the period (T2−t8).

The effect of heat receive at the print dot LQ2 in a high energy part upon the corresponding print dot q1 can be prevented by reducing the heating time by the period t8 as described above.

(2) Case that print data exists at print dots q1 and RQ2

In the printing control range of the low energy part shown in FIG. 11D, in case print data exists only at the corresponding print dot q1, no print data exists at q2 and q3, print data exists at the print dot RQ2 in the high energy part shown in FIG. 11C and no print data exists at Q2, Q3 and LQ2, q1 is 1, q2 is 0, q3 is 0, Q2 is 0, Q3 is 0, LQ2 is 0 and RQ2 is 1 in FIG. 11A.

At this time, the NAND circuit 19 outputs '1' because q2 is 0 and Q2 is 0 and the NAND circuit 20 outputs '1' because q3 is 0 and Q3 is 0.

Also, '1' is applied to one input circuit of the NAND circuit 26 because RQ2 is 1 and the output of the exclusive OR circuit 27 is input to the other input circuit. Therefore, as the case that print data exists at the print dots q1 and LQ2 described in (1), the exclusive OR circuit 27 outputs '1' only for the period t8 shown in FIG. 12B, outputs '0' for the other period and FET1 controls that the heater of the thermal head connected to FET1 is heated only for a period (T1−t8).

The effect of heat receive at the print dot RQ2 in the high energy part upon the corresponding print dot q1 can be prevented by reducing the heating time by the period t8 as described above.

(3) Case that print data exists at print dots q1, LQ2 and RQ2

In case print data exists only at the corresponding print dot q1, no print data exists at q2 and q3, print data exists at the print dots LQ2 and RQ2 in the high energy part shown in FIG. 11C and no print data exists at Q2 and Q3 in the printing control range of the low energy part shown in FIG. 11D, q1 is 1, q2 is 0, q3 is 0, Q2 is 0, Q3 is 0, LQ2 is 1 and RQ2 is 1 in FIG. 11A.

At this time, as the case that print data exists at the print dots q1 and LQ2 described in (1), the exclusive OR circuit 27 outputs '1' only for the period t8 shown in FIG. 12B, outputs '0' for the other period and FET1 controls so that the heater of the thermal head connected to FET1 is heated only for the period (T2−t8).

The effect of heat receive at the print dots LQ2 and RQ2 in the high energy part upon the corresponding print dot q1 can be prevented by reducing the heating time by the period t8 as described above.

In case a dot to be printed exists at LQ2 and RQ2 as described above, the similar control to a case that a dot to be printed exists at either of LQ2 or RQ2 is executed and the reason is as follows.

That is, the reason is that in such multicolor printing, it is required that a boundary between each color is definitely output, in addition, such a bit hardly exists at intervals and a request for a complicated control circuit required to precisely correspond to such a case is hardly made.

(4) Case that print data exists at print dots q1, Q2 and LQ2

In the printing control range of the low energy part shown in FIG. 11D, in case print data exists only at the corresponding print dot q1, no print data exists at q2 and q3, print data exists at the print dots Q2 and LQ2 in the high energy part shown in FIG. 11C and no print data exists at Q3 and RQ2, q1 is 1, q2 is 0, q3 is 0, Q2 is 1, LQ2 is 1, Q3 is 0 and RQ2 is 0 in FIG. 11A.

At this time, the NAND circuit 20 outputs '1' because q3 is 0 and Q3 is 0. However, in the NAND circuit 19, though q2 is 0, '1' is input to the signal input circuit of q2 from Q2 via the diode 30. Further, as a signal acquired by inverting GATE C1 shown in FIG. 12B by the inverter 23 is applied to the NAND circuit 19, the NAND circuit 19 outputs 10 only for a period t6 shown in FIG. 12B and outputs '1' for the other period.

Also, '1' is applied to one input circuit of the NAND circuit 26 via the diode 32 because LQ2 is 1 and the output of the exclusive OR circuit 27 is input to the other input circuit. At this time, as a signal acquired by inverting GATE C2 shown in FIG. 12B by the inverter 24 and a signal acquired by inverting GATE C3 shown in FIG. 12B by the inverter 25 are applied to the exclusive OR circuit 27, the exclusive OR circuit 27 outputs '1' only for the period t8 shown in FIG. 12B in which '1' and '0' of both signals do not accord and outputs '0' for the other period. Therefore, the NAND circuit 26 outputs '0' only for the period t8 and outputs '1' for the other period.

Therefore, as the multi-input AND circuit 6-0 outputs '1' for a residual period (t7+t9) acquired by subtracting the periods t6 and t8 from a period T2 according to STROBE2 shown in FIG. 12B and the multi-input AND circuit 4 and the OR circuit 2 also output '1' only for the period (t7+t9) T2−(t6+t8), FET1 is also turned on only for the period and controls so that the heater of the thermal head connected to FET1 is heated only for the period [(T2−(t6+t8)].

The effect of heat receive at the print dots Q2 and LQ2 in a high energy part upon the corresponding print dot q1 can be prevented by reducing the heating time by the period (t6+t8) as described above.

(5) Case that print data exists at print dots q1, Q3 and LQ2

In the printing control range of the low energy part shown in FIG. 11D, in case print data exists only at the corresponding print dot q1, no print data exists at q2 and q3, print data exists at the print dots Q3 and LQ2 in the high energy part shown in FIG. 11C and no print data exists at Q2 and RQ2, q1 is 1, q2 is 0, q3 is 0, Q2 is 0, Q3 is 1, LQ2 is 1 and RQ2 is 0 in FIG. 11A.

At this time, the NAND circuit 19 outputs '1' because q2 is 0 and Q2 is 0. However, in the NAND circuit 20, though q3 is 0, '1' is input to the signal input circuit of q3 from Q3 via the diode 31. Further, the output of the exclusive OR circuit 21 is input to the other input circuit of the NAND circuit 20. At this time, as a signal acquired by inverting GATE C1 shown in FIG. 12B by the inverter 23 and a signal acquired by inverting GATE C2 shown in FIG. 12B by the inverter 24 are applied to the exclusive OR circuit 21, the exclusive OR circuit 21 outputs '1' only for a period t7 shown in FIG. 12B in which both signals do not accord shown in FIG. 12B and outputs '0' for the other period. Therefore, the NAND circuit 20 outputs '0' only for the period t7 and outputs '1' for the other period.

Also, the NAND circuit 26 outputs '0' only for the period t8 and outputs '1' for the other period as shown in the case that print data exists at the print dots q1 and LQ2 described in (1) because LQ2 is 1 and the output of the exclusive OR circuit 27 is input to the other input circuit.

Therefore, as the multi-input AND circuit 6-0 outputs '1' for a residual period (t6+t9) acquired by subtracting the periods t7 and t8 from the period T2 according to STROBE2 shown in FIG. 12B and the multi-input AND circuit 4 and the OR circuit 2 also output '1' only for the period (t6+t9)= T2−(t7+t8), FET1 is also turned on only for the period and controls so that the heater of the thermal head connected to FET1 is heated only for the period [(T2−(t7+t8)].

The effect of heat receive at the print dots Q3 and LQ2 in a high energy part upon the corresponding print dot q1 can be prevented by reducing the heating time by the period (t7+t8) as described above.

In a case except the cases described above, a bad effect which a dot to be printed in a high energy part has can be also prevented by the control circuit shown in FIG. 11A.

As high energy printing control and low energy printing control can be very precisely executed as described above, two-color data can be precisely printed even if the two-color data are mixed.

Figure 13A:
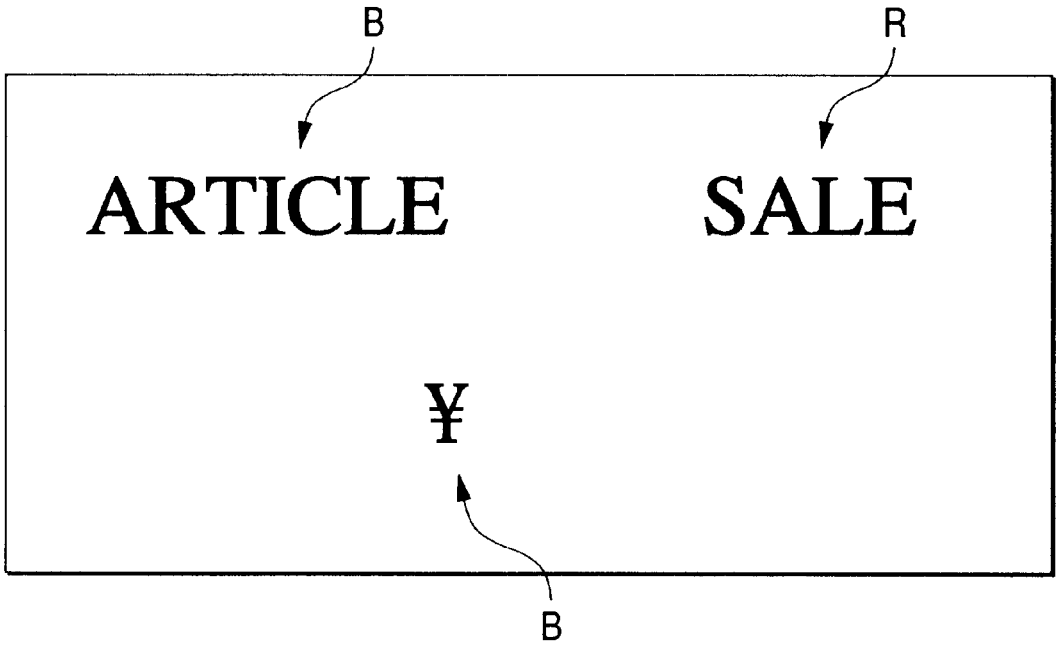
FIGS. 13A and 13B are explanatory drawings for explaining a state printed in plural colors.
Figure 13B:
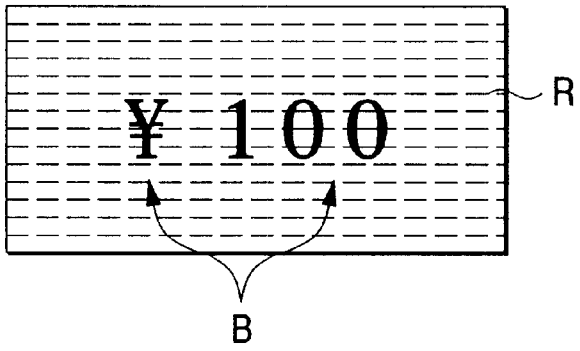

For example, as shown in FIG. 13A, in case a black character area B and a red character area R are respectively blocked on paper, the black area and the red area can be also definitely printed by the control circuit shown in FIG. 6. However, when a dot of the low energy part exists in a part adjacent to a dot of the high energy part and before and after the dot in case a black character on a red background is printed as shown in FIG. 13B, that is, in case a red area R and a black area B are mixed, there is a detect that as printing of a low energy part is developed in color close to printing of a high energy part by the printing of the high energy part, a character and a pattern become indefinite. However, according to the art described above, as a bad effect which high energy data has upon low energy data can be also effectively controlled in case plural types of input energy data are mixed as shown in FIG. 13B, clear and precise printing is also enabled in the case shown in FIG. 13B.

Third Embodiment

In the second embodiment as described above, in case two parts of a red part (a low energy part) and a black part (a high energy part) exist in an image, the data of the low energy part and the data of the high energy part are stored in different memories and as shown in FIG. 10, the data (q) for the low energy part and the data (Q) for the high energy part are required to be input to the shift register 40 in parallel.

Figures 14A, 14B, 14C:
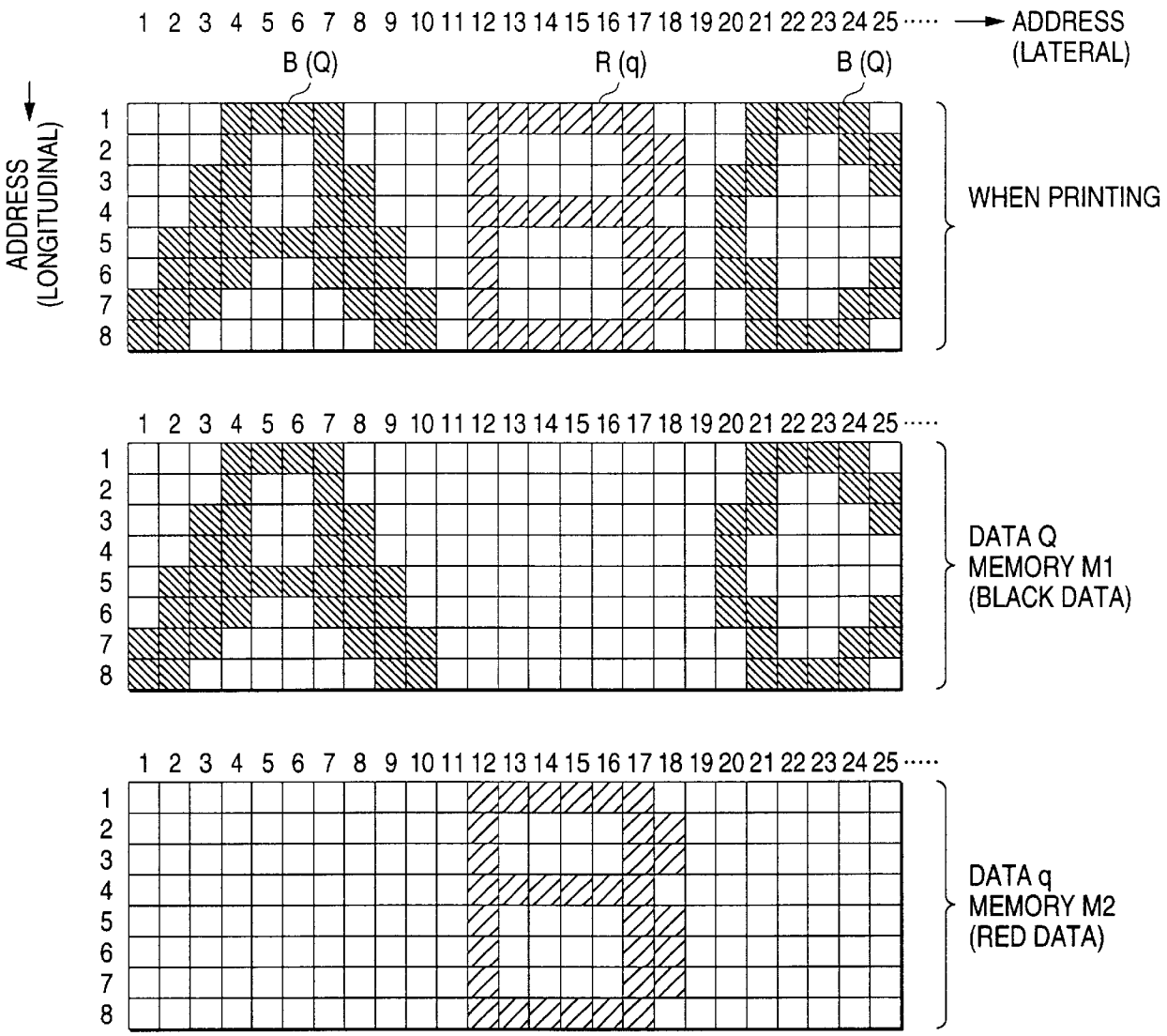
FIGS. 14A and 14C are explanatory drawings for explaining image data.
Figure 15:
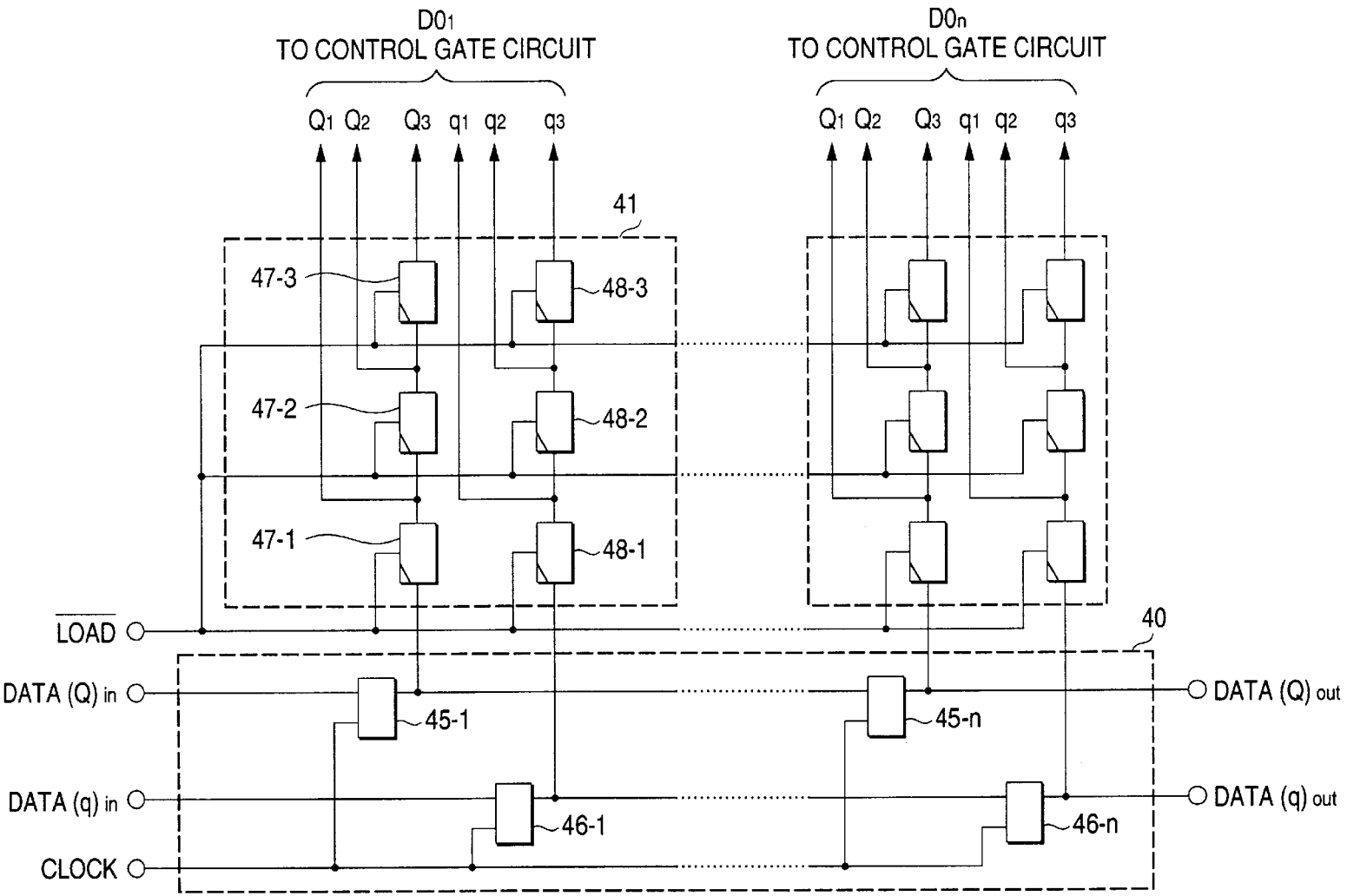
FIG. 15 is a detail drawing showing a shift register and registers for data-hold.

Therefore, when an image including a black part (A, C, - - - ) and a red part (B, - - - ) as shown in FIG. 14A is printed, data Q for a high energy part is stored in a memory M1, data q for a low energy part is stored in a memory M2 as shown in FIG. 14B and 14C, these are read in parallel and are required to be input to the shift register 40 in the second embodiment. FIG. 15 is a detail drawing showing the shift register 40 and the register for data-hold 41 shown in FIG. 10.

Therefore, there is a problem that as two memories of the memory for high energy and the memory for low energy are required, the cost is increased.

As shown in FIG. 15, reference numbers 45-1 to 45-n denote a first shift register element for storing the data of a high energy part in the shift register 40, 46-1 to 46-n denote a second shift register element for storing the data of a low energy part in the shift register 40, 47-1 to 47-3 denote a first register element for storing data within the printing control range of a high energy part in the register for data-hold 41, and 48-1 to 48-3 denote a second register element for storing data within the printing control range of a low energy part in the register for data-hold 41.

Figure 1:
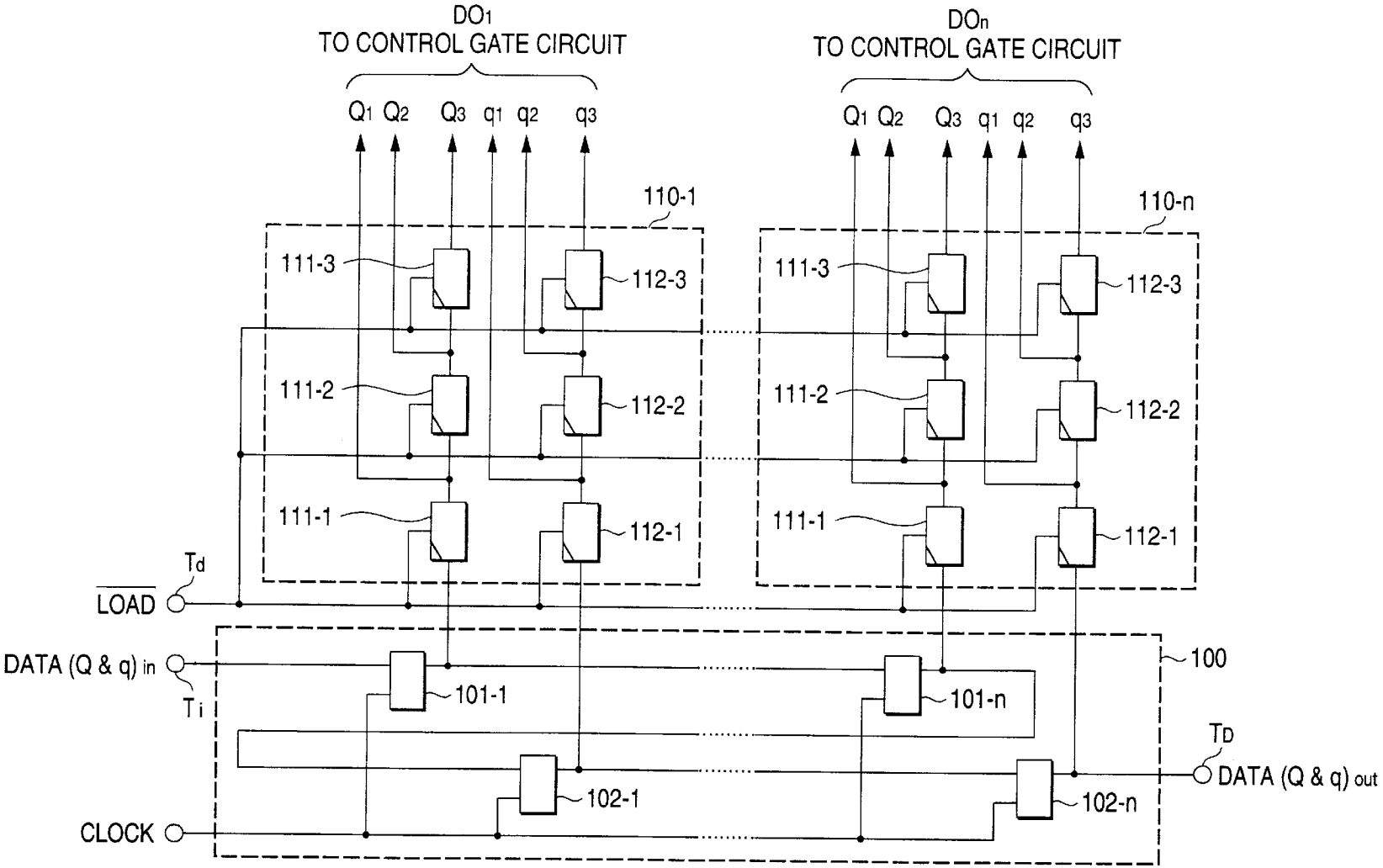
FIG. 1 shows third embodiment of the invention.
Figure 2A:
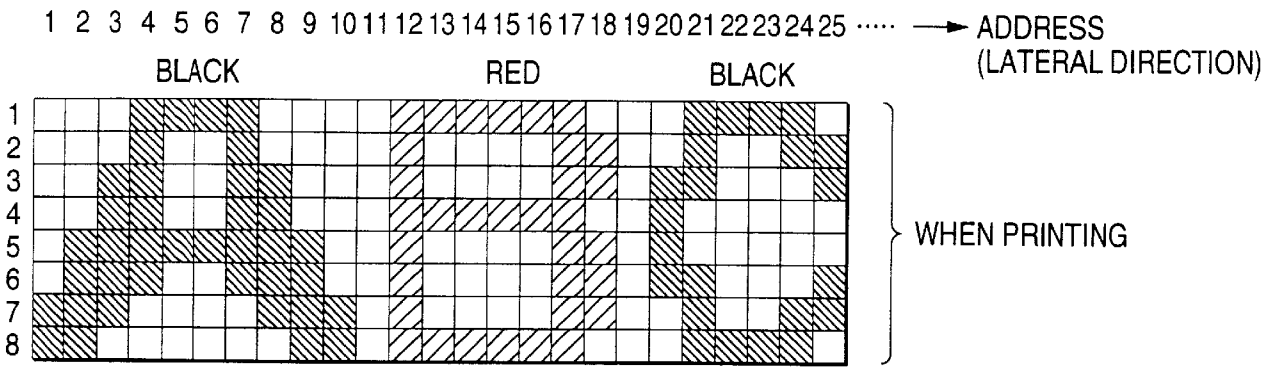
FIGS. 2A and 2B are explanatory drawings for explaining the state of data in the third embodiment of the invention.
Figure 2B:
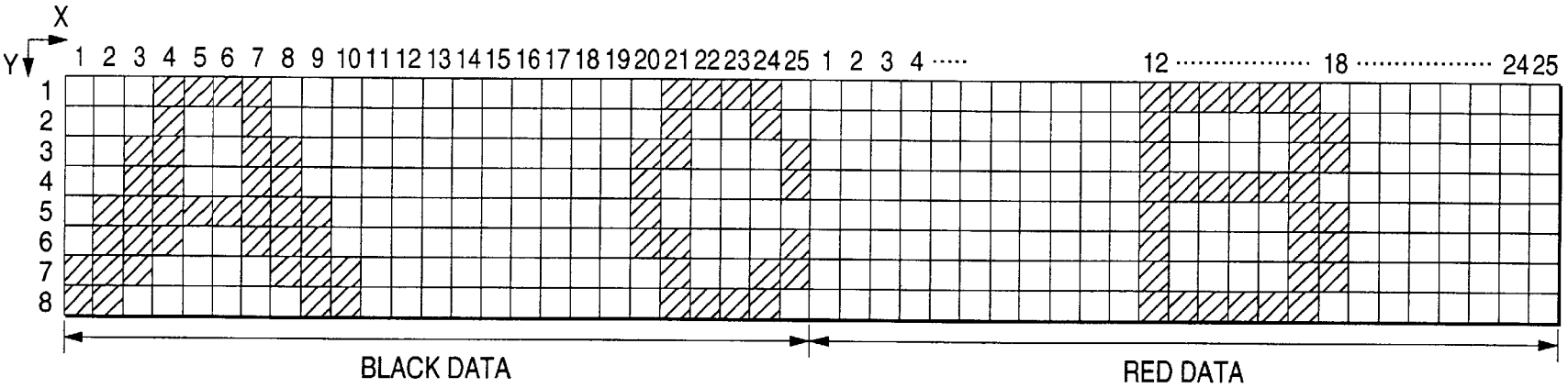

Referring to FIGS. 1 and 2, a third embodiment of the invention will be described below. FIG. 1 shows an embodiment of the invention, FIGS. 2 are explanatory drawings for explaining its data, FIG. 2A is an explanatory drawing for explaining an output screen in printing and FIG. 2B is an explanatory drawing for explaining a data memory.

As shown in FIG. 1, a reference number 100 denotes a shift register, 101-1 to 101-n denote a first shift register element, 102-1 to 102-n denote a second shift register element, 110-1 to 110-n denote a register for data-hold, 111-1 to 111-3 denote a first register element and 112-1 to 112-3 denote a second register element.

The shift register 100 stores data to be printed and is provided with the first shift register elements 101-1 to 101-n to any of which print data of a high energy part Q is input and the second shift register elements 102-1 to 102-n to any of which print data of a low energy part q is input. Also, the first shift register elements 101-1 to 101-n are connected in series and the second shift register elements 102-1 to 102-n are connected in series. As the first shift register element 101-n last connected of the first shift register elements and the second shift register element 102-1 first connected of the second shift register elements are connected in series, the first shift register element 101-1 to the second shift register element 102-n are all finally connected in series.

The register for data-hold 110-1 stores data to be printed and data in a printing control range and is provided with a first register element 111-1 for storing print data of a high energy part Q, a first register element 111-2 for storing print data on a printing line before by one line of the print data of the high energy part, a first register element 111-3 for storing print data on a printing line before by two lines of the print data of the high energy part, a first register element 112-1 for storing print data of a low energy part q, a second register element 112-2 for storing print data on a printing line before by one line of the print data of the low energy part and a second register element 112-3 for storing print data on a printing line before by two lines of the print data of the low energy part.

The first register element 111-1 to the first register element 111-3 are connected in series and the second register element 112-1 to the second register element 112-3 are also connected in series.

The register 110-n for data-hold is also similarly configured to the register 110-1 for data-hold.

Next, referring to FIG. 2, print data will be described. FIG. 2 explain an example that print data is the size of 25×8 the number of bits in a lateral direction of which is 25 and the number of bits in a longitudinal direction of which is 8 for simplification, letters A and C are printed and output in black (high energy) as shown in FIG. 2A and a letter B is printed and output in red (low energy) between A and C.

At this time, the print data is developed in an image area of the memory as shown in FIG. 2B. At this time, the data of the letters A and C to be printed and output in black are written to a black data area equivalent to first 25 bits in the lateral direction and the data of the letter B to be printed and output in red is written to a red data area equivalent to the next 25 bits. At this time, the data of each letter is written corresponding to a position to be printed. That is, in case as shown in FIG. 2A, the letter A is printed on 1st to 10th dots in the lateral direction, the letter B is printed on 12th to 18th dots and the letter C is printed on 20th to 25th dots, A is written to 1st to 10th bits in the black data area in the memory, C is written to 20th to 25th bits and B is written to 12th to 18th bits in the red data area respectively as shown in FIG. 2B. The black data area and the red data area are serially read.

In printing, data in the lateral direction when Y is 1 in the memory area shown in FIG. 2B is first sequentially read from the right to the left in the direction of the x-axis, that is, from a higher order address to a lower order address. Hereby, first, the data of 25th to 1st bits in the read data area is read and is sequentially input to the input terminal Ti of the shift register 100 shown in FIG. 1. In case "n" is 25 in FIG. 1, the data of 25th to 1st bits in the read data area is first written to the first shift register elements 101-25 to 101-1 to which print data of a high energy part is written.

The data of 25th to 1st bits in the black data area is successively read and is sequentially input to the input terminal Ti. At this time, as data is sequentially transferred from the first shift register element 101-25 to the second shift register element 102-1, hereby the data of the 25th to 1st bits in the red data area is written to the second shift register elements 102-25 to 102-1 this time and the data of the 25th to 1st bits in the black data area is written to the first shift register elements 101-25 to 101-1.

When a load signal is input to an input terminal Td shown in FIG. 1, data written to the first shift register element 101-1 is held in the first register element 111-1 of the register for data-hold 110-1, and data written in the second shift register element 102-1 is held in the second register element 112-1. Data written to the corresponding first or second shift register element of the shift register 100 is also similarly held in the other register for data-hold.

The data held in the first register element 111-1 is input to Q1 of the control circuit and the data held in the second register element 112-1 is input to q1. At this time, data respectively held in the first register elements 111-2 and 111-3 are respectively input to Q2 and Q3 and data respectively held in the second register elements 112-2 and 112-3 are respectively input to q2 and q3, however, in the case of first data in the lateral direction when Y is 1, these data are all zero. Control over printing is executed based upon these.

Next, data in the lateral direction when Y is 2 in the memory area shown in FIG. 2B is similarly read. Hereby, data the value on the x-axis of which is 25 to 1 in the read data area and successively, data the value on the x-axis of which is 25 to 1 in the black data area are sequentially read and are sequentially input to the input terminal Ti of the shift register 100 shown in FIG. 1. Hereby, this time, the data the value on the x-axis when Y is 2 in the read data area of which is 25 to 1 are written to the second shift register elements 102-25 to 102-1. The data the value on the x-axis when Y is 2 in the black data area of which is 25 to 1 are written to the first shift register elements 101-25 to 101-1.

When a load signal is input to the input terminal Td shown in FIG. 1, data held in the first register element 111-1 till then, that is, data when Y and X are both 1 in the black data area is held in the first register element 111-2 of the register for data-hold 110-1 and data when X is 1 on the corresponding second printing line in the black data area newly written to the first shift register element 101-1 is held in the first register element 111-1.

Similarly, data held in the first register element 112-1 till then, that is, data when Y and X are both 1 in the red data area is held in the second register element 112-2 of the register for data-hold 110-1 and data when X is 1 on the corresponding second printing line in the red data area newly written to the second shift register element 102-1 is held in the second register element 112-1.

At third time, data in the lateral direction when Y is 3 in the memory area shown in FIG. 2B is similarly read. Hereby, data the value on the x-axis in the read data area of which is 25 to 1 and successively, data the value on the x-axis in the black data area of which is 25 to 1 are sequentially read and are sequentially input to the input terminal Ti of the shift register 100 shown in FIG. 1. Hereby, this time, the data the value on the x-axis when Y is 3 in the read data area of which is 25 to 1 are written to the second shift register elements 102-25 to 102-1. The data the value on the x-axis when Y is 3 in the black data area of which is 25 to 1 are written to the first shift register elements 101-25 to 101-1.

When a load signal is input to the input terminal Td shown in FIG. 1, data held in the first register element 111-2 till then, that is, data when Y and X are both 1 in the black data area is held in the first register element 111-3 of the register for data-hold 110-1, data held in the first register element 111-1 till then, that is, data when Y is 2 and X is 1 in the black data area is held in the first register element 111-2 and data when X is 1 on the corresponding third printing line in the black data area newly written to the first shift register element 101-1 is held in the first register element 111-1.

Similarly, data held in the first register element 112-2 till then, that is, data when Y and X are both 1 in the red data area is held in the second register element 112-3 of the register for data-hold 110-1, data held in the second register element 112-1 till then, that is, data when Y is 2 and X is 1 in the red data area is held in the second register element 112-2 and data when X is 1 on the corresponding third printing line in the red data area newly written to the second shift register element 102-1 is held in the second register element 112-1.

Similar control is executed over the other registers for data-hold 110-2 not shown, - - - . As described above, data Q1 to Q3 and q1 to q3 held in the registers for data-hold 110-1, - - - are transmitted to the control circuit and printing control described above is executed.

Mainly referring to FIG. 3, a second embodiment of the invention will be described below. A data input format to a shift register in the second embodiment of the invention is not fixed to a serial method but can correspond to both the serial method and a parallel method, either is selected according to a request of a user and the degree of freedom of a user is increased.

Figure 3:
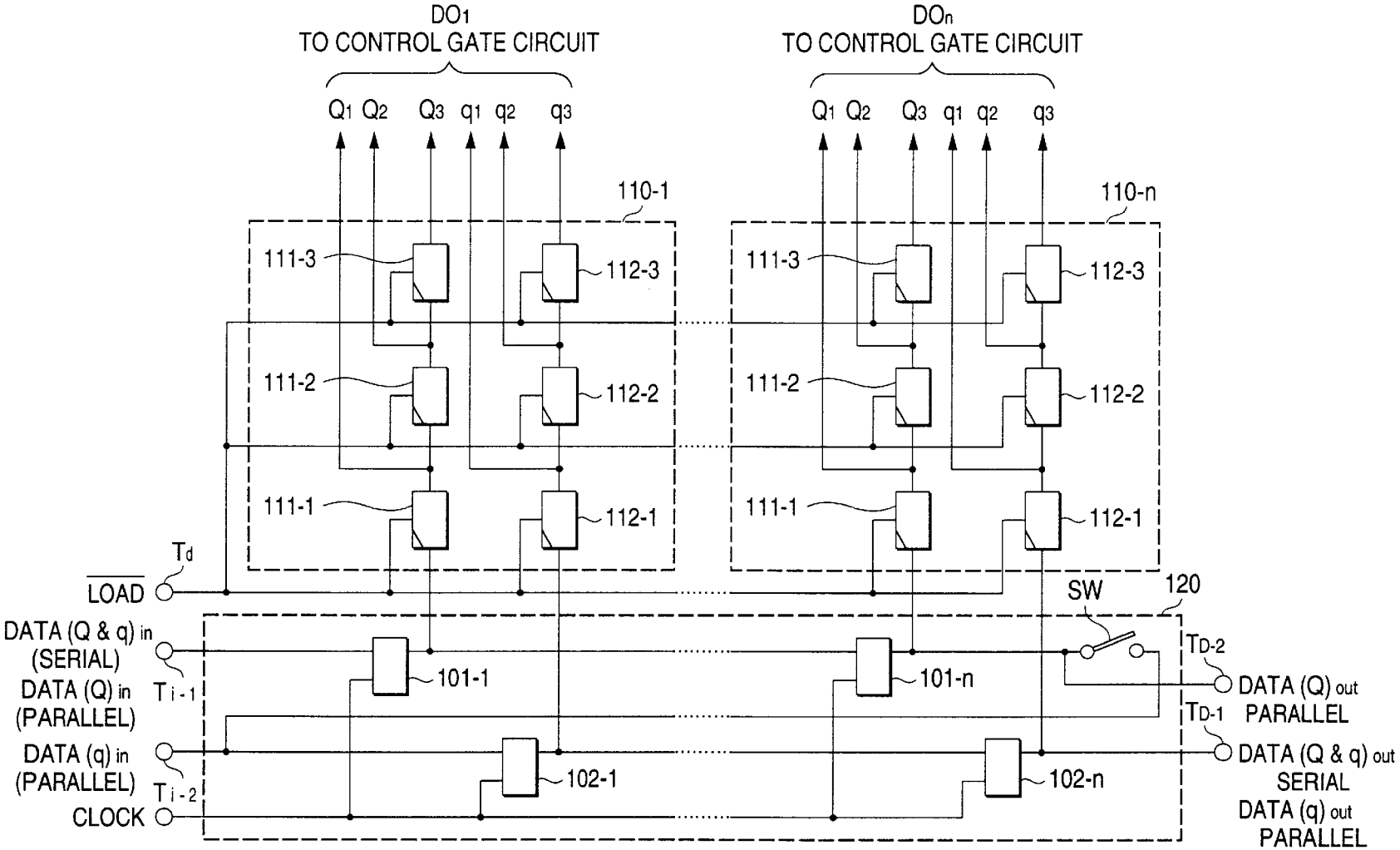
FIG. 3 shows a fourth embodiment of the invention.
Figure 4A:
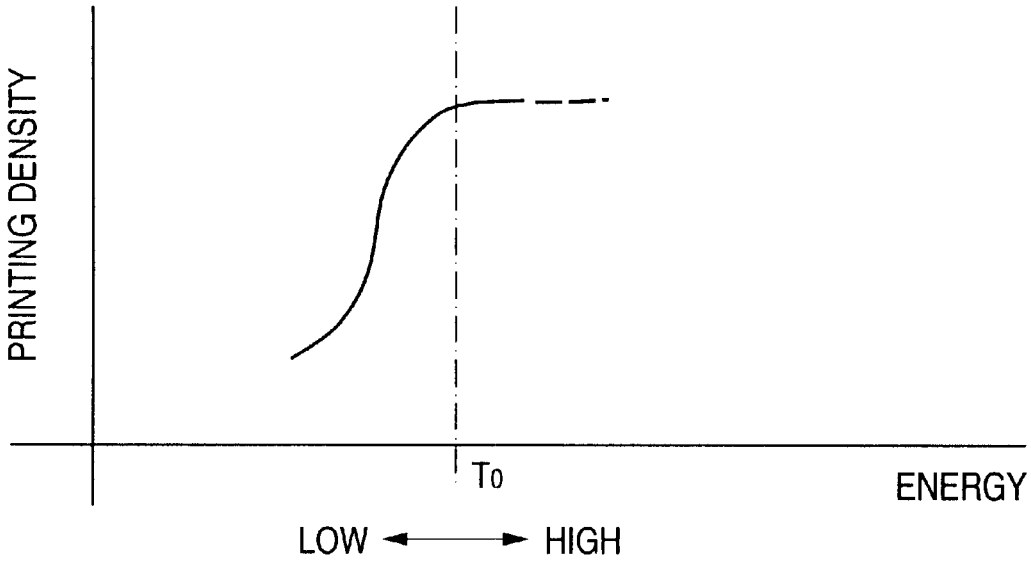
FIGS. 4A and 4B are explanatory drawings showing relationship between thermosensitive paper and printing energy.
Figure 4B:
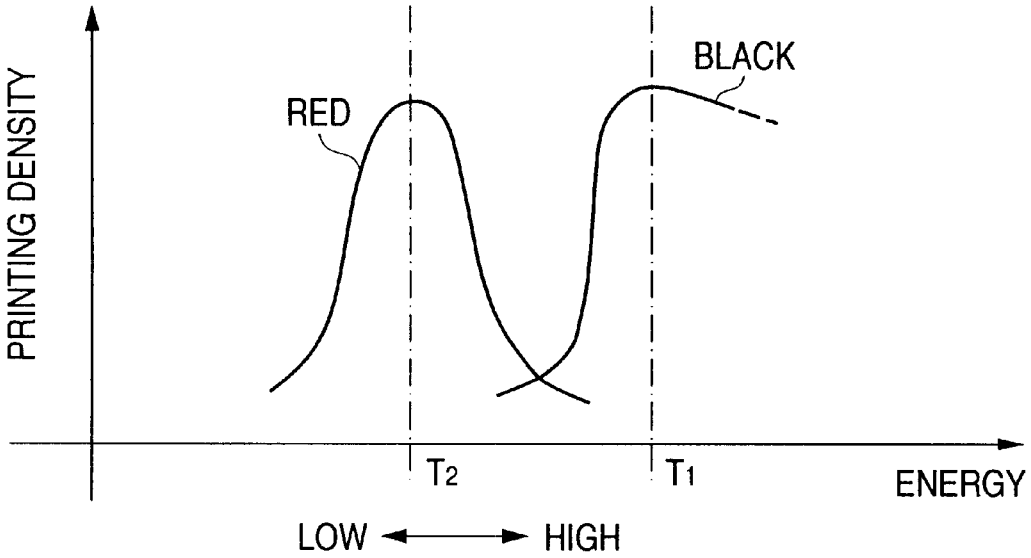

FIG. 3 shows the second example of the third embodiment of the invention, the same reference number shows the same part as that in the other drawings and a reference number 120 denotes a shift register.

The shift register 120 is configured so that print data for high energy and print data for low energy can be serially input to it and can be input to it in parallel, is provided with first shift register elements 101-1 to 101-n and second shift register elements 102-1 to 102-n respectively as shown in FIG. 1, and the output side of the first shift register element 101-n and the input side of the second shift register element 102-n are connected in series by connecting these via a selector switch SW.

An input terminal Ti-1 connected to the input side of the first shift register element 101-1 is used for a first input terminal which can be used in serial input and in parallel input and an input terminal Ti-2 connected to the input side of the second shift register element 102-1 is used for a second input terminal used in parallel input.

Also, an output terminal To-1 connected to the output side of the second shift register element 102-n is used for a first output terminal used both in serial output and in parallel output, and an output terminal To-2 connected to the output side of the first shift register element 101-n is used for a second output terminal used in parallel output.

In case the shift register 120 is used in a serial method, the selector switch SW is turned on, and the second input terminal Ti-2 and the second output terminal To-2 are disabled. Data shown in FIG. 2B is input from the first input terminal Ti-1 as described above. Hereby, the similar operation to that described in relation to FIG. 1 can be executed.

Also, in case the shift register 120 is used in parallel method, the selector switch SW is turned off. Black data (high energy) shown in FIG. 14B is input from the first input terminal Ti-1 and red data (low energy) shown in FIG. 14C is input from the second input terminal Ti-2. Hereby, the shift register can be operated by parallel input similarly to that in the conventional type case.

As in the case of parallel input, as plural memories having small capacity have only to be provided as shown in FIG. 14 though in the case of serial input shown in FIG. 1, a memory having large capacity shown in FIG. 2B is required, a user can judge for which method his/her own memory is suitable and can select a suitable one, and the degree of freedom of a user can be increased by enabling the selection of serial input or parallel input.

As in the case of serial input, processing data rate becomes slow unless data shift processing is executed according to a clock having double speed of speed in the case of parallel input, it is required to speed up a clock.

When a serial method and a parallel method can be selected, one type of clock suitable for the one selected by a user may be also provided, two types of clocks are provided and either may be also selected according to selection by a user.

Also, the case of a serial method may be also based upon not only the unit of n pieces as described above but the unit of dot.

According to the invention, the following action and effect can be produced.

Data in one scanning line can be printed concurrently by a plural kinds of energy. Because a plural times scannings for each of colors are unnecessary, multi-color printing is realized by the thermal head.

Further, according to the present invention, data holding means for storing printing data is provided. Not only concurrently printing the data in one scanning line with a plural kind of energy, a thermal history control is also realized based on the previous printing data.

According to the invention, as the shift register elements are serially connected, the data of a high energy part and the data of a low energy part can be input from the same input terminal, the data of a high energy part and the data of a low energy part are not required to be read from separate memories and can be acquired from one memory.

As the connection of the shift register elements can be selected out of a serial method and a parallel method via the switching means, both can be used depending upon selection by a user, the degree of freedom of a user is increased and the thermal head easy to use can be provided.

What is claimed is:

1. A thermal head comprising:

heating means for heating a thermosensitive recording medium which has a plurality of developing peaks, by plural different energies;

first heating control means for executing a heating control to apply a first energy corresponding to a first developing peak of the thermosensitive medium;

second heating control means for executing a heating control to apply a second energy corresponding to a second developing peak of the thermosensitive medium;

first heating correction means for correcting the heating by said first heating control means based on print data in a print control range of a current printing data to be subjected the heating control by said first heating control means; and second heating correction means for correcting the heating by said second heating control means based on print data in a print control range of a current printing data to be subjected the heating control by said second heating control means.

2. A thermal head as claimed in claim 1, further comprising data holding means for holding print data for a plurality of printing lines.

3. A thermal head as claimed in claim 1, further comprising connection means for notifying said second heating correction means with print data being printed by the first energy, which influence the heating control by said second heating control means, wherein said second heating correction means controls the heating time period according to a signal transmitted from said connection means.

4. A thermal head as claimed in claim 2, further comprising connection means for notifying said second heating correction means with print data being printed by the first energy, which influence the heating control by said second heating control means, wherein said second heating correction means controls the heating time period according to a signal transmitted from said connection means.

5. A thermal head as claimed in claim 2, wherein said data holding means comprises a first shift register to which first energy print data the printing of which is controlled by first energy is written, and a second shift register to which second energy print data the printing of which is controlled by second energy is written, and said first shift register and second shift register are connected in series.

6. A thermal head as claimed in claim 5, further comprising: switching means for connecting said first shift register and said second shift register, when the switching means is in a state one of on or off, the first shift register and the second shift register are connected in series, while when the switching means is in the other state, the first shift register and the second shift register are connected in parallel.

7. A thermal head comprising:

a heater which heats a thermosensitive recording medium having a plurality of developing energy peaks, by plural different energies;

a first input unit which inputs a first strobe signal defining a heating time period to apply a first energy corresponding to a first developing energy peak of the thermosensitive medium;

a second input unit which inputs a second strobe signal defining a heating time period to apply a second energy corresponding to a second developing energy peak of the thermosensitive medium;

first logical circuit which corrects the heating time period by said first input means based on print data in a print control range of a current printing data to be subjected the heating control by said first input means; and second logical circuit which corrects the heating time period by said second input means based on print data in a print control range of a current printing data to be subjected the heating control by said second input means.

8. A thermal head as claimed in claim 7, further comprising a shift register which holds print data for a plurality of printing lines.

9. A thermal head as claimed in claim 7, wherein print data being printed by the first energy, which influence the heating control by said second heating control means, is notified to said second logical circuit, said second logical circuit controls the heating time period according to a signal thus notified.

10. A thermal head as claimed in claim 8, wherein print data being printed by the first energy, which influence the heating control by said second heating control means, is notified to said second logical circuit, said second logical circuit controls the heating time period according to a signal thus notified.

11. A thermal head as claimed in claim 8, wherein said shift register comprisesd: a first shift register to which first energy print data the printing of which is controlled by first energy is written, and a second shift register to which second energy print data the printing of which is controlled by second energy is written, and said first shift register and second shift register are connected in series.

12. A thermal head as claimed in claim 11, further comprising: switching means for connecting said first shift register and said second shift register, when the switching means is in a state one of on or off, the first shift register and the second shift register are connected in series, while when the switching means is in the other state, the first shift register and the second shift register are connected in parallel.

13. A method for driving a thermal head, comprising the steps of:

inputting a first strobe signal defining a heating time period to apply a first energy corresponding to a first developing energy peak of the thermosensitive medium;

inputting a second strobe signal defining a heating time period to apply a second energy corresponding to a second developing energy peak of the thermosensitive medium;

correcting the heating time period by said first input means based on print data in a print control range of a current printing data to be subjected the heating control by said first input means; and correcting the heating time period by said second input means based on print data in a print control range of a current printing data to be subjected the heating control by said second input means.

14. A driving control apparatus for a thermal head comprising:

heating means for heating a thermosensitive recording medium which has a plurality of developing peaks, by plural different energies;

first heating control means for executing a heating control to apply a first energy corresponding to a first developing peak of the thermosensitive medium;

second heating control means for executing a heating control to apply a second energy corresponding to a second developing peak of the thermosensitive medium;

first heating correction means for correcting the heating by said first heating control means based on print data in a print control range of a current printing data to be subjected the heating control by said first heating control means; and second heating correction means for correcting the heating by said second heating control means based on print data in a print control range of a current printing data to be subjected the heating control by said second heating control means.

15. A thermal printer comprising:

heating means for heating a thermosensitive recording medium which has a plurality of developing peaks, by plural different energies;

first heating control means for executing a heating control to apply a first energy corresponding to a first developing peak of the thermosensitive medium;

second heating control means for executing a heating control to apply a second energy corresponding to a second developing peak of the thermosensitive medium;

first heating correction means for correcting the heating by said first heating control means based on print data in a print control range of a current printing data to be subjected the heating control by said first heating control means; and second heating correction means for correcting the heating by said second heating control means based on print data in a print control range of a current printing data to be subjected the heating control by said second heating control means.

* * * * *